US006372398B1

(12) United States Patent
Yamada et al.

(10) Patent No.: US 6,372,398 B1
(45) Date of Patent: Apr. 16, 2002

(54) ELECTRONIC DEVICE, MANUFACTURING METHOD OF ELECTRONIC DEVICE, ELECTROPHOTOGRAPHIC PHOTORECEPTOR, AND PROCESS CARTRIDGE

(75) Inventors: Wataru Yamada, Hadano; Katsumi Nukada, Odawara; Rie Ishii, Atsugi; Mieko Seki, Odawara, all of (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/722,684

(22) Filed: Nov. 28, 2000

(30) Foreign Application Priority Data

Apr. 18, 2000 (JP) ..... 2000-117139

(51) Int. Cl.[7] ..... G03G 15/04
(52) U.S. Cl. ..... 430/66; 430/67; 399/159
(58) Field of Search ..... 430/66, 67; 399/159

(56) References Cited

U.S. PATENT DOCUMENTS 5,116,703 A 5/1992 Badesha et al.

FOREIGN PATENT DOCUMENTS

JP A 9-188764 7/1997
JP A 9-190004 7/1997
JP B2 2721106 11/1997
JP A 10-251277 9/1998

OTHER PUBLICATIONS

H. Nakazumi et al., "Coloration of Glasses with Organic Reactive Dyes", J. Chem. Soc., Chem. Comm., 1992.
D. S. Wiess et al., "Analysis of Electrostatic Latent Image Blurring Caused by Photoreceptor Surface Treatments", Proceedings of IS&T's Eleventh International Congress on Advances in Non–Impact Printing Technologies.

*Primary Examiner*—Mark Chapman
(74) *Attorney, Agent, or Firm*—Oliff & Berridge, PLC

(57) ABSTRACT

The present invention relates to a manufacturing method of an electronic device comprising the steps of: preparing at least two kinds of hydrolytic silicon compounds that are different in reactivity to water; preparing a protective group precursor having a substituent having a reactivity to water equal or substantially equal to the reactivity of a reactive group of one of the hydrolytic silicon compounds to water; exchanging a reactive group of the other hydrolytic silicon compound with the substituent of the protective group precursor; preparing a silicon-containing coating agent containing the one of the hydrolytic silicon compounds and a hydrolytic silicon compound having the reactive group which has been exchanged with the substituent of the protective group precursor; and coating and curing the silicon-containing coating agent on a base plate so that at least one layer of a cured film is formed.

16 Claims, No Drawings

ELECTRONIC DEVICE, MANUFACTURING METHOD OF ELECTRONIC DEVICE, ELECTROPHOTOGRAPHIC PHOTORECEPTOR, AND PROCESS CARTRIDGE

BACKGROUND OF THE INVENTION

1. Field of the Invention

The present invention relates to an electronic device having a cured film that is obtained by applying a silicon-containing coating agent and curing it, and a manufacturing method thereof. It also concerns an electrophotographic photoreceptor and a process cartridge having such an electrophotographic photoreceptor.

2. Description of the Related Art

Silicon-containing coating agents (resin) have unique characteristics different from those of other resins, such as heat resistance, oxidation stability, weatherability (light, ozone, radioactive rays), electrical characteristics (insulating characteristic, corona resistant property), interface property (mold-releasing property, foam-eliminating property, water repellency), etc.; therefore, these agents have been widely used as sealing agents, coating agents, bonding agents, etc. in various fields, such as building and construction industries, machining industries, electricity industries, the medical field and automobile industries.

In recent years, much attention has been focussed on the application of these coating agents to the electronic devices field. Research efforts have been made in the application of organic photo-functional materials to the electronic device field because of their productivity, ease of material designing, safety, etc. particularly in organic electronic devices such as electrophotographic photoreceptors, organic electro-luminescent elements, memory elements and wavelength conversion elements, and various modifications have been made, and these organic photo-functional materials have been put into practical use. From the viewpoint of stability and long life in these organic electronic devices, for example, in organic electro-luminescent elements, there have been demands for those materials which would not cause a morphological change in a film due to generated joule heat.

Moreover, in the electrophotographic photoreceptors, there have been demands for those organic photo-functional materials which are not only chemically stable with respect to ozone, NOx, etc. but also physically stable with respect to various physical stresses such as heat and mechanical force.

In the field of electrophotographic photoreceptors, in order to meet such demands, silicon-containing coating agents have been proposed, for example, those disclosed in "Proceedings of IS & T's Eleventh International Congress on Advances in Non-Impact Printing Technologies, p. 57 to 59", U.S. Pat. No. 2575536 and Japanese Patent Application Laid-Open (JP-A) No. 9-190004. In these references, a sol-gel method is used to form a three-dimensional firm network by using siloxane bonds; thus, an organic-inorganic hybridization is carried out so as to greatly improve the mechanical strength.

Normally, an organic material and an inorganic material have poor compatibility because they have greatly different characteristics, and even when they are simply mixed, it is difficult to form a uniformly cured film. For this reason, in JP-A No. 9-190004, an organic silicon-modified positive-hole carrier compound, which is formed by directly introducing a group (silicon-containing group) containing silicon and having a hydrolytic property into an electric charge carrier agent, is used so that the inorganic material and the organic material are firmly chemical-bonded to each other directly and uniformly soluble in each other.

Moreover, a method has been proposed in which a silicon-containing group is directly introduced into a photo-responsive material and dispersed in inorganic glass; and the application of this method has been considered not only in electrophotographic photoreceptors, but also in various fields such as coloring of glass, surface protecting in polymer lenses and coating, bonding layers between FRP as well as carbon fiber reinforced resin fiber and polymers, non-linear optical materials, photo-chromic materials and photochemical hole burning materials, and further development of these materials is expected.

However, even in the case when a functional organic silicon compound to which a silicon-containing group is directly introduced is used, if it is simply mixed and applied, a phase separation takes place prior to the curing reaction and a uniform film is not obtained. Therefore, in general, as disclosed in U.S. Pat. No. 5,116,703 and JP-A No. 9-188764, a functional organic silicon compound and an inorganic material precursor are preliminarily subjected to a common hydrolytic process and after having been allowed to react partially, a coating process is carried out. In this common hydrolytic process, these materials are dissolved in a solvent that can dissolve them. An acidic catalyst, such as acetic acid, hydrochloric acid, sulfuric acid, phosphoric acid or nitric acid, and various ester-exchange catalysts such as metallic alkoxide, etc., together with an appropriate amount of water are added and these are allowed to react. This method is very effective in obtaining a uniform film.

In order to obtain such a uniform film, the reactivity of the functional organic silicon compound and the inorganic material precursor with respect to the hydrolytic reaction, condensation reaction, etc. need to be made approximately the same. In general, since the reactivity of a silicon compound is determined by the kind of a hydrolytic group (reactive group), it is preferable to use the same hydrolytic group in both of the functional organic silicon compound and the inorganic material precursor.

With respect to the synthesizing method for a functional organic silicon compound having a hydrolytic group, various methods have been proposed, for example, in JP-A No. 10-251277 and J. Chem. Soc. Chem. Commun. (1992) p. 1079–1080. Silicon-containing groups in the functional organic silicon compound synthesized in these methods mostly have high reactivity; for example, SiOMe and SiOEt. This is because most of the commercially available inorganic precursors are limited to those having a high reactivity for the purpose of shortening the reaction time of hydrolysis and condensation, and increasing the reaction point, etc. For this reason, in order to form a uniform film, it is necessary to replace the hydrolytic substitution group in the functional organic silicon compound with a group having higher reactivity.

However, when synthesized, a compound having a hydrolytic group having a comparatively high reactivity tends to react with the small amount of moisture contained in the reaction solvent, or tends to be adsorbed in an adsorbent, causing a reduction in the yield and subsequent high costs. In particular, since the materials for the functional materials are expensive, the disadvantage in terms of cost is significant. Moreover, since the functional materials need to be highly purified, processes for refining the synthesized compound in various methods are required; however, because of its high reactivity, applicable adsorbents, solvents, etc. are limited, and high purification is difficult. Furthermore, the reaction conditions such as temperature and catalysts at the time of synthesizing are limited, with the result that the synthesis routes are limited, causing a reduction in the kinds of the functional organic silicon compounds to be synthesized. For this reason, with respect to the hydrolytic group, it is preferabe to use those having low reactivity at the time of production.

However, when a common hydrolytic process is carried out by using a low-reactive functional organic silicon compound and a highly-reactive inorganic material precursor, the hydrolytic process of the highly-reactive compound progresses much faster, with the result that the composition of the coating agent tends to become ununiform, form deposition, and cause gelation. When a film is formed by using such coating agent, an ununiform film tends to be formed and it fails to maintain sufficient stability against stresses such as heat and mechanical force.

Moreover, when such an ununiform coating agent is used for manufacturing an electrophotographic photoreceptor, protrusions tend to be formed on the coated surface, causing trouble such as an image loss. This phenomenon can be avoided to a certain extent by filtering the coating agent. However, the preparation of such processes results in high costs. Furthermore, such a coating agent tends to again form deposition after the filtration or to cause gelation. These phenomena are observed even in the case of materials having high compatibility; however, when materials which each have low compatibility are used, or, for example, when functional materials whose organic component has a high molecular weight, such as not less than 200, 300, or further, not less than 400 and which have low compatibility with an inorganic component, are used, this tendency is observed more clearly.

As described above, the functional organic silicon compound needs to have the opposing characteristics of a low reactivity at the time of synthesizing and a high reactivity at the time of common hydrolysis. In order to satisfy these opposing characteristics, after a low-reactive functional organic silicon compound has been synthesized, in a common hydrolytic process, the reactivity of the functional organic silicon compound and an inorganic material precursor to hydrolysis need to be made equal or substantially equal by using a certain method. However, such an effective method for solving the problems has not been developed.

SUMMARY OF THE INVENTION

The objective of the present invention is to provide an electronic device on which a highly-functional cured film is formed by using a silicon-containing coating agent which is capable of providing a uniform film, and which is formed by using a plurality of hydrolytic silicon compounds, each having a different reactivity to water, and a manufacturing method of such an electronic device, and also to provide an electrophotographic photoreceptor and a process cartridge having such an electrophotographic photoreceptor.

The inventors of the present invention have done much research in order to solve the above-mentioned problems, and have found that a silicon-containing coating agent, which is manufactured through a process in which the reactivity of at least two kinds of hydrolytic silicon compounds having different reactivity to water are made equal or substantially equal, is applied to the surface of a base substrate so as to form at least one layer, and then cured to obtain an electronic device having a cured film with a uniform composition and high functions. They also have found that when an electrophotographic photoreceptor is manufactured by using such a cured film and installed into a process cartridge, it becomes possible to improve its durability, etc.

The objects described above can be achieved by the following means:

A first aspect of the present invention is a manufacturing method of an electronic device comprising the steps of: preparing at least two kinds of hydrolytic silicon compounds that are different in reactivity to water; preparing a protective group precursor having a substituent having a reactivity to water equal or substantially equal to the reactivity of a reactive group of one of the hydrolytic silicon compounds to water; exchanging a reactive group of the other hydrolytic silicon compound with the substituent of the protective group precursor, thereby making the reactivity of the other hydrolytic silicon compound to water equal or substantially equal to the reactivity of the one of the hydrolytic silicon compounds to water; preparing a silicon-containing coating agent containing the one of the hydrolytic silicon compounds and a hydrolytic silicon compound having the reactive group which has been exchanged with the substituent of the protective group precursor; and coating and curing the silicon-containing coating agent on a base plate so that at least one layer of a cured film is formed.

A second aspect of the present invention is an electronic device comprising: a base member having one or more layers of cured film formed by applying a silicon-containing coating agent thereto and cured thereon, wherein the silicon-containing coating agent is formed in processes in which: at least two kinds of hydrolytic silicon compounds that are different in reactivity to water are prepared; a protective group precursor having a substituent having a reactivity to water equal or substantially equal to the reactivity of a reactive group of one of the hydrolytic silicon compounds to water is prepared; a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water; and a silicon-containing coating agent containing the one of the hydrolytic silicon compounds and a hydrolytic silicon compound having the reactive group which has been exchanged with the substituent of the protective group precursor is prepared.

A third aspect of the present invention is an electrophotographic photoreceptor comprising: a base member having one or more layers of cured film formed by applying a silicon-containing coating agent thereto and cured thereon, wherein the silicon-containing coating agent is formed in processes in which: at least two kinds of hydrolytic silicon compounds that are different in reactivity to water are prepared; a protective group precursor having a substituent having a reactivity to water equal or substantially equal to the reactivity of a reactive group of one of the hydrolytic silicon compounds to water is prepared; a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water; and a silicon-containing coating agent containing the one of the hydrolytic silicon compounds and a hydrolytic silicon compound having the reactive group which has been exchanged with the substituent of the protective group precursor is prepared.

A fourth aspect of the present invention is a process cartridge comprising: an electrophotographic photoreceptor and at least one member selected from the group consisting of a charging device, a static eliminator and a cleaning device, and which is detachably attached to an image-forming apparatus, wherein the electrophotographic photoreceptor comprising: a base member having one or more layers of cured film formed by applying a silicon-containing coating agent thereto and cured thereon, wherein the silicon-containing coating agent is formed in processes in which: at least two kinds of hydrolytic silicon compounds that are different in reactivity to water are prepared; a protective group precursor having a substituent having a reactivity to water equal or substantially equal to the reactivity of a reactive group of one of the hydrolytic silicon compounds to water is prepared; a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water; and a silicon-containing coating agent containing the one of the hydrolytic silicon compounds and a hydrolytic silicon compound having the reactive group which has been exchanged with the substituent of the protective group precursor is prepared.

DESCRIPTION OF THE PREFERRED EMBODIMENTS

The following description will discuss an electronic device, a manufacturing method of such an electronic device, an electrophotographic photoreceptor and a process cartridge, in accordance with the present invention.

[A] Electronic Device

The electronic device of the present invention is an electronic device which is composed of a base member and one or more layers of cured film formed by applying a silicon-containing coating agent thereto and cured thereon, and the silicon-containing coating agent is formed as follows: At least two kinds of hydrolytic silicon compounds that are different in reactivity to water are prepared, and a protective group precursor having a substituent having a reactivity to water equal or substantially equal to the reactivity of a reactive group of one of the hydrolytic silicon compounds to water is prepared, and a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water, and a silicon-containing coating agent containing the one of the hydrolytic silicon compounds and a hydrolytic silicon compound having the reactive group which has been exchanged with the substituent of the protective group precursor is prepared.

The following description will discuss the silicon-containing coating agent and its manufacturing method, and also explain an electronic device in accordance with the present invention in detail.

[1] Silicon-containing coating agent

The silicon-containing coating agent of the present invention, which is mainly composed of at least two kinds of hydrolytic silicon compounds, is made from, for example, a functional organic silicon compound that is a hydrolytic silicon compound and an inorganic material precursor that is also a hydrolytic silicon compound, and these are maintained in a partially hydrolyzed state.

(1) Functional organic silicon compound

The functional organic silicon compound is preferably prepared as a compound represented by the following formula (I).

$$F\text{—}[D\text{—}A]_b \qquad (I)$$

(In formula (I), F represents an organic group derived from a functional compound, D represent a flexible sub-unit, A represents a substitutional silicon group having a hydrolytic group, represented by $\text{—}Si(R^1)_{(3-a)}Q_a$, $R^1$ represents a hydrogen atom, an alkyl group, or a substituted or unsubstituted aryl group, Q represents a hydrolytic group, a represents an integer of 1 to 3, and b represents an integer of 1 to 4.)

Specific examples of D include a bivalent hydrogen carbide group represented by $\text{—}C_nH_{2n}\text{—}$, $\text{—}C_nH_{(2n-2)}\text{—}$ and $\text{—}C_nH_{(2n-4)}\text{—}$ (where n is an integer of 1 to 15), —COO—, —S—, —O—, $\text{—}CH_2\text{—}C_6H_4\text{—}$, —N=CH—, $\text{—}C_6H_4\text{—}C_6H_4\text{—}$, and combinations of these, to which a substituent is added. Moreover, b is preferably set to an integer of 2 to 4. When b is set to 2 to 4, no less than two Si atoms are contained in a photo-functional organic silicon compound represented by formula (I) so that an inorganic glassy network is more easily formed so that the mechanical strength can be increased.

In formula (I), specific examples of F include organic groups derived from phthalocyanine compounds, porphyrin compounds, azobenzene compounds, tris(bipyridyl)-rhodium compounds, triarylamine compounds, benzidine compounds, stilbene compounds, anthracene compounds, hydrazone compounds, etc. In particular, organic groups derived from positive-hole carrier compounds are preferably used. Moreover, with respect to F in formula (I), any portion may be used as long as it has a photo-functionality, and for example, those represented by the following formula (II) may be listed. However, the present invention is not intended to be limited thereby. Here, the portion having a photo-functionality refers to a portion that displays any of functions, such as changes in refractive index, changes in conductivity, non-linear optical effects, changes in structure and changes in color.

Examples of F in formula (I) preferably include organic groups derived from organic silicon-modified positive-hole carrier compounds represented by the following formula (II), and more specifically, aryl alkane compounds and aryl-substituted ethylene compounds are particularly preferable. However, the above-mentioned compounds are only listed as examples, and the present invention is not intended to be limited by these.

(II)

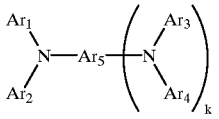

(In formula (II), $Ar_1$ to $Ar_4$ independently represent substituted or unsubstituted aryl groups, $Ar_5$ represents a substituted or unsubstituted aryl or arylene group, and k represents 0 or 1. Moreover, among $Ar_1$ to $Ar_5$, 1 to 4 of them have bonds hands bondable to bonding groups represented by —D—A. D represents a flexible sub-unit, A represents a substitutional silicon group having a hydrolytic group represented by $—Si(R^1)_{(3-a)}Q_a$, $R^1$ represents a hydrogen atom, an alkyl group, or a substituted or unsubstituted aryl group, Q represents a hydrolytic group, and a represents an integer of 1 to 3.)

In formula (II), $Ar_1$ to $Ar_4$ independently represent substituted or unsubstituted aryl groups, and more specifically, are preferably selected from the following structural group 1.

Structural Group 1

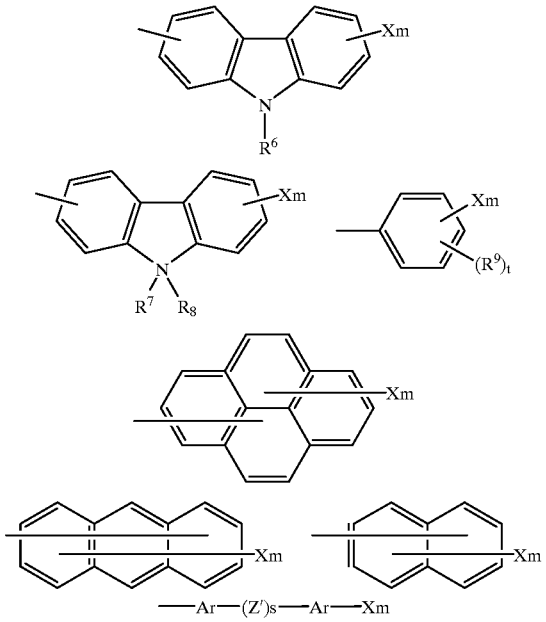

Moreover, Ar is preferably selected from the following structural group 2.

Structural Group 2

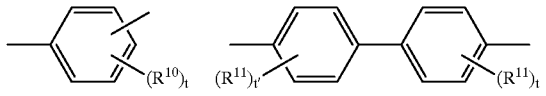

Furthermore, Z' is preferably selected from the following structural group 3.

Structural Group 3

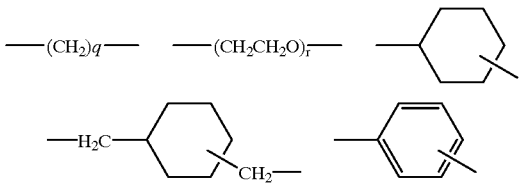

-continued

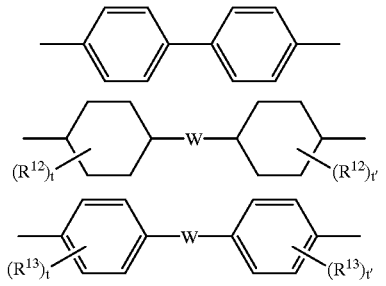

Here, $R^6$ represents at least one selected from the group consisting of a hydrogen atom, an alkyl group having 1 to 4 carbon atoms, a phenyl group substituted by an alkyl group having 1 to 4 carbon atoms or an alkoxy group having 1 to 4 carbon atoms or an unsubstituted phenyl group, and an aralkyl group having 7 to 10 carbon atoms. $R^7$ to $R^{13}$ are selected from a hydrogen atom, an alkyl group having 1 to 4 carbon atoms, or an alkoxy group having 1 to 4 carbon atoms, a phenyl group substituted by an alkyl group having 1 to 4 carbon atoms, or an unsubstituted phenyl group, an aralkyl group having 7 to 10 carbon atoms and a halogen. m and s represent 0 or 1, q and r represent integers of 1 to 10, and t and t' represent integers of 1 to 3. Here, X has a bonding hand bondable to a bonding group represented by —D—A indicated by the definition of formula (I).

W is preferably selected from the following structural group 4.

Structural Group 4

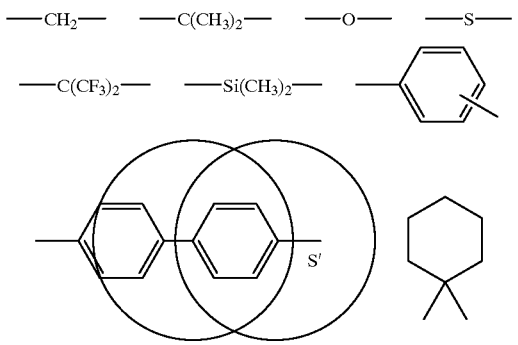

(where s' represents an integer of 0 to 3.)

With respect to a specific structure of $Ar_5$ in formula (II), in the case of k=0, the above-mentioned structure of $Ar_1$ to $Ar_4$ where m=1 is listed, and in the case of k=1, the structure of $Ar_1$ to $Ar_4$ where m=0 is listed. Moreover, in the case of k=1, in any one of $Ar_1$ to $Ar_4$, m=1 holds.

Specific examples of the organic silicon-modified positive-hole carrier compound include those shown in the following Tables 1 to 7; however, the present invention is not intended to be limited thereby. Here, specific examples in the Tables are shown in a manner so as to specify k in formula (II), and among $Ar_1$ to $Ar_5$, with respect to the group having a bond hand bondable to —D—A, the group is specified in a state including —D—A so that formula (II) is specified as a compound. Moreover, in the Tables "Me" represents a methyl group, and "iPr" represents an isopropyl group.

TABLE 1
| No. | $Ar_1$ | $Ar_2$ | $Ar_3$ | $Ar_4$ | $Ar_5$ | k | S |
|---|---|---|---|---|---|---|---|
| 1 | 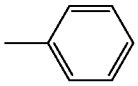 | 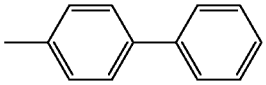 | — | — | 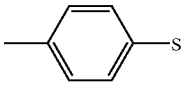 | 0 | —$(CH_2)_4$—Si(OiPr)$_3$ |
| 2 | 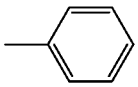 | 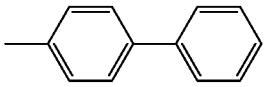 | — | — | 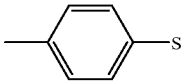 | 0 | —CH═CH—$(CH_2)_2$— —Si(OiPr)$_3$ |
| 3 | 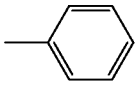 | 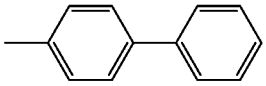 | — | — | 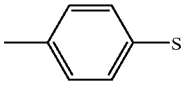 | 0 | CH═N—$(CH_2)_3$— —Si(OiPr)$_3$ |
| 4 | 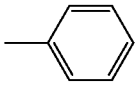 | 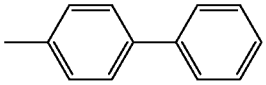 | — | — | 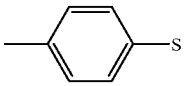 | 0 | —O—$(CH_2)_3$—Si(OiPr)$_3$ |
| 5 | 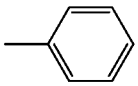 | 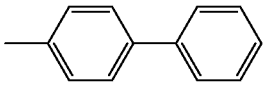 | — | — | 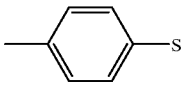 | 0 | —COO—$(CH_2)_3$— —Si(OiPr)$_3$ |
| 6 | 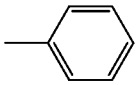 | 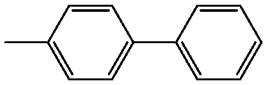 | — | — | 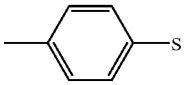 | 0 | —$(CH_2)_2$—COO— —$(CH_2)_3$—Si(OiPr)$_3$ |
| 7 | 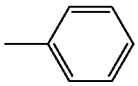 | 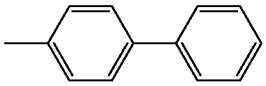 | — | — | 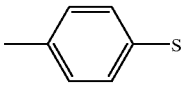 | 0 | —$(CH_2)_2$—COO— —$(CH_2)_3$—Si(OiPr)$_2$Me |
| 8 | 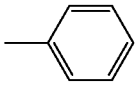 | 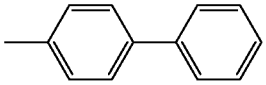 | — | — | 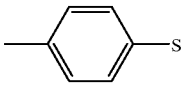 | 0 | —$(CH_2)_2$—COO— —$(CH_2)_3$—Si(OiPr)Me$_2$ |
| 9 | 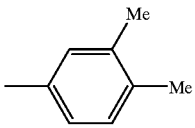 | 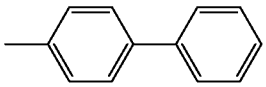 | — | — | 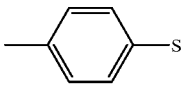 | 0 | —$(CH_2)_4$—Si(OiPr)$_3$ |
TABLE 2
| No | $Ar_1$ | $Ar_2$ | $Ar_3$ | $Ar_4$ | $Ar_5$ | k | S |
|---|---|---|---|---|---|---|---|
| 10 | 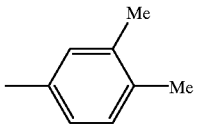 | 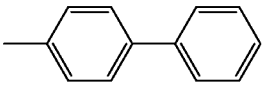 | — | — | 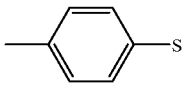 | 0 | —$(CH_2)_2$—COO— —$(CH_2)_3$— Si(OiPr)$_3$ |
| 11 | 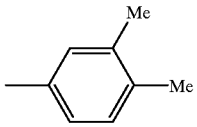 | 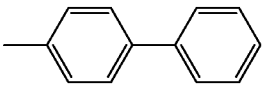 | — | — | 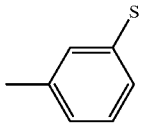 | 0 | —O—$(CH_2)_3$— Si(OiPr)$_3$ |

TABLE 2-continued
| No | $Ar_1$ | $Ar_2$ | $Ar_3$ | $Ar_4$ | $Ar_5$ | k | S |
|---|---|---|---|---|---|---|---|
| 12 | 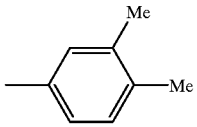 | 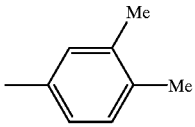 | — | — | 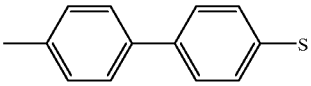 | 0 | —COO—$(CH_2)_3$ —Si(OiPr)$_3$ |
| 13 | 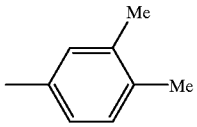 | 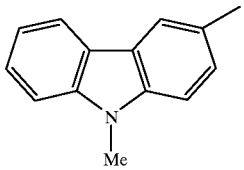 | — | — | 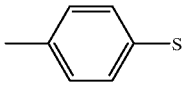 | 0 | —$(CH_2)$4— Si(OiPr)$_3$ |
| 14 | 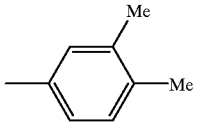 | 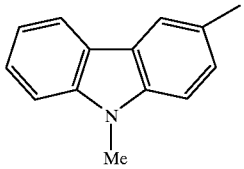 | — | — | 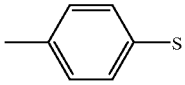 | 0 | —$(CH_2)_2$—COO— —$(CH_2)_3$— Si(OiPr)$_3$ |
| 15 | 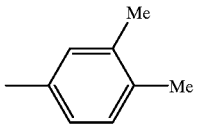 | 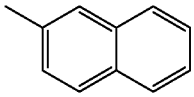 | — | — | 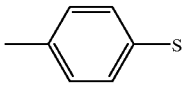 | 0 | —$(CH_2)_4$— Si(OiPr)$_3$ |
TABLE 3
| No. | $Ar_1$ | $Ar_2$ | $Ar_3$ | $Ar_4$ |
|---|---|---|---|---|
| 16 | 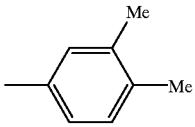 | 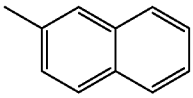 | — | — |
| 17 | 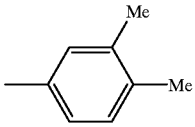 | 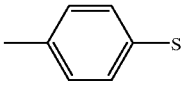 | 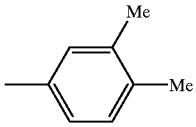 | 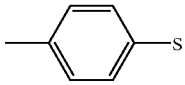 |
| 18 | 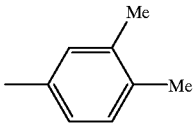 | 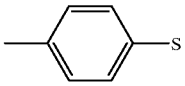 | 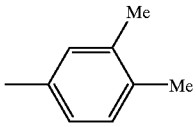 | 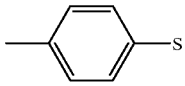 |
| 19 | 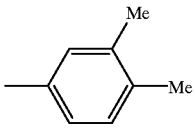 | 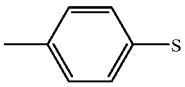 | 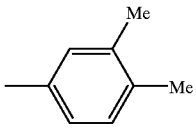 | 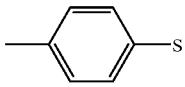 |
| 20 | 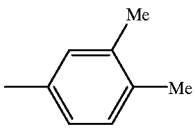 | 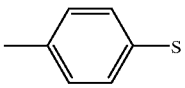 | 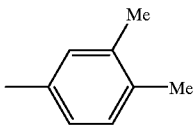 | 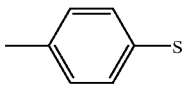 |

TABLE 3-continued
| | | | | |
|---|---|---|---|---|
| 21 | 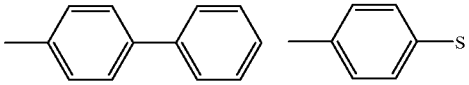 | | — | — |
| 22 | 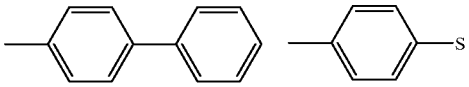 | | — | — |
| No. | $Ar_5$ | | k | S |
| 16 | 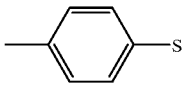 | | 0 | —$(CH_2)_2$—COO— —$(CH_2)_3$—Si(OiPr)$_3$ |
| 17 | 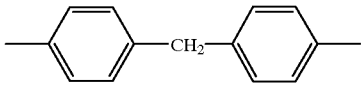 | | 0 | —$CH_2)_4$—Si(OiPr)$_3$ |
| 18 | 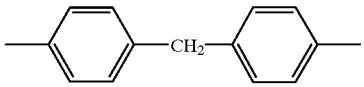 | | 0 | —$(CH_2)_2$—COO— —$(CH_2)_3$—Si(OiPr)$_3$ |
| 19 | 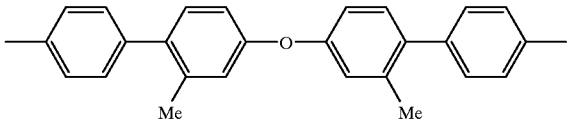 | | 0 | —$(CH_2)$4—Si(OiPr)$_3$ |
| 20 | 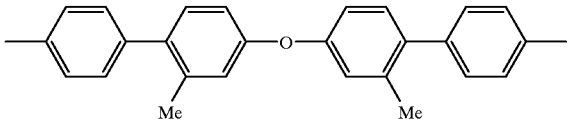 | | 0 | —$(CH_2)_2$—COO— —$(CH_2)_3$—Si(OiPr)$_3$ |
| 21 | 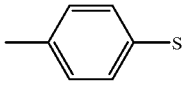 | | 0 | —$(CH_2)_2$—COO— —$(CH_2)_3$—Si(OiPr)$_3$ |
| 22 | 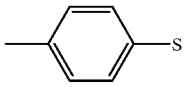 | | 0 | —$(CH_2)_2$—COO— —$(CH_2)_3$—Si(OiPr)$_2$Me |
TABLE 4
| No | $Ar_1$ | $Ar_2$ | $Ar_3$ | $Ar_4$ |
|---|---|---|---|---|
| 23 | 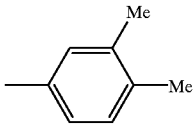 | 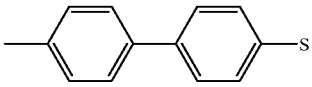 | — | — |
| 24 | 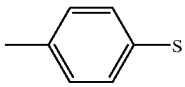 | 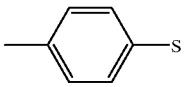 | — | — |
| 25 | 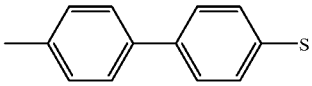 | 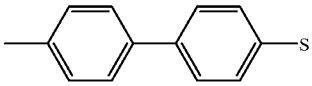 | — | — |

TABLE 4-continued
| | | | | |
|---|---|---|---|---|
| 26 | 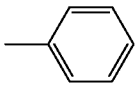 | 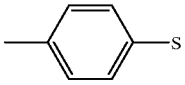 | 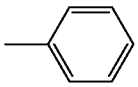 | 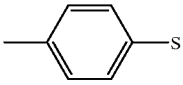 |
| 27 | 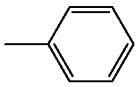 | 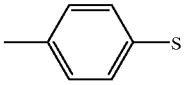 | 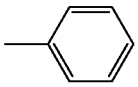 | 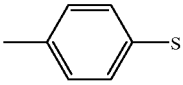 |
| 28 | 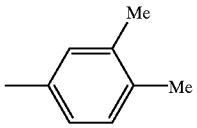 | 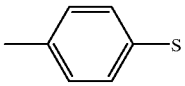 | 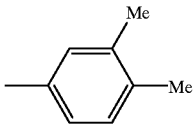 | 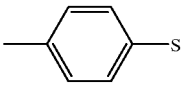 |
| 29 | 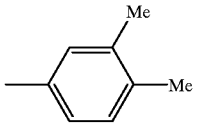 | 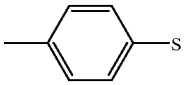 | 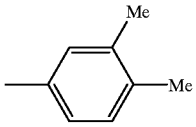 | 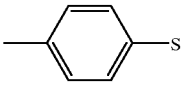 |
| 30 | 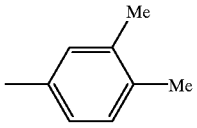 | 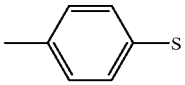 | 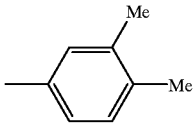 | 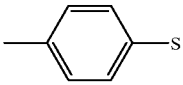 |
| No | $Ar_5$ | k | S |
|---|---|---|---|
| 23 | 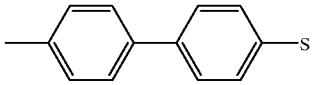 | 0 | —COO—$(CH_2)_3$— —Si(OiPr)$_3$ |
| 24 | 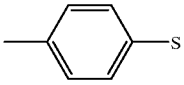 | 0 | —$(CH_2)_2$—COO— —$(CH_2)_3$—Si(OiPr)$_3$ |
| 25 | 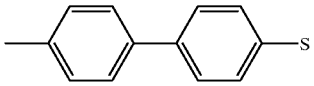 | 0 | —COO—$(CH_2)_3$— —Si(OiPr)$_3$ |
| 26 | 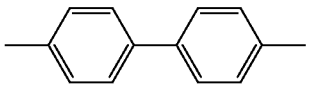 | 1 | —$(CH_2)_4$—Si(OiPr)$_3$ |
| 27 | 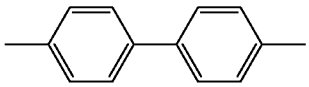 | 1 | —CH═CH—$(CH_2)_2$— —Si(OiPr)$_3$ |
| 28 | 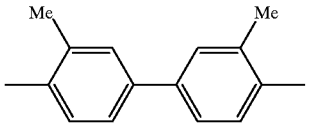 | 1 | —$(CH_2)_4$—Si(OiPr)$_3$ |
| 29 | 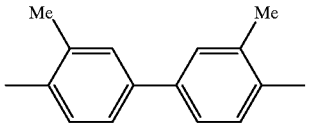 | 1 | —CH═CH—$(CH_2)_2$— —Si(OiPr)$_3$ |

TABLE 4-continued
| | | | | | |
|---|---|---|---|---|---|
| | | 30 | 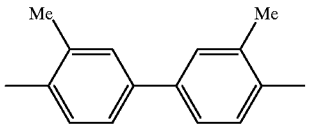 | 1 | —CH═N—$(CH_2)_3$— —Si(OiPr)$_3$ |
TABLE 5
| No | $Ar_1$ | $Ar_2$ | $Ar_3$ | $Ar_4$ |
|---|---|---|---|---|
| 31 | 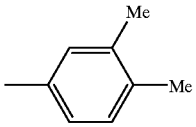 | 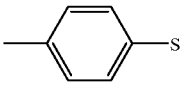 | 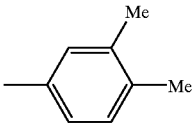 | 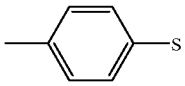 |
| 32 | 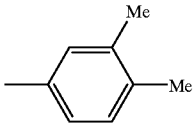 | 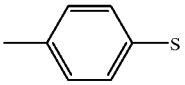 | 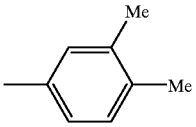 | 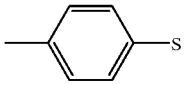 |
| 33 | 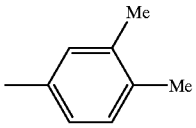 | 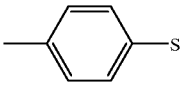 | 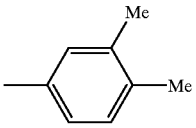 | 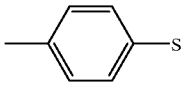 |
| 34 | 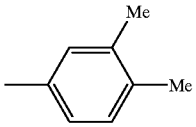 | 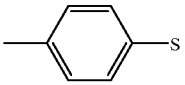 | 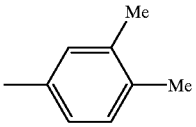 | 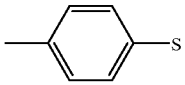 |
| 35 | 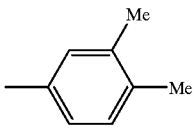 | 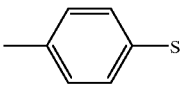 | 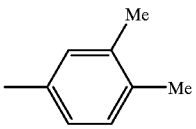 | 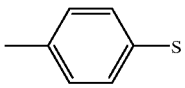 |
| 36 | 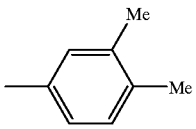 | 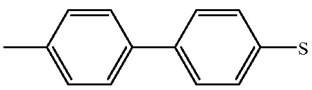 | 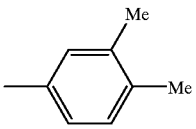 | 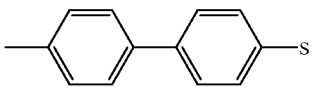 |
| No | $Ar_5$ | k | S |
|---|---|---|---|
| 31 | 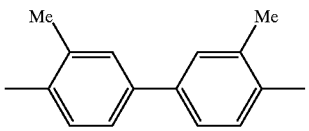 | 1 | —O—$(CH_2)_3$—Si(OiPr)$_3$ |
| 32 | 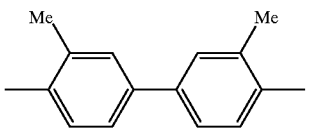 | 1 | —COO—$(CH_2)_3$— —Si(OiPr)$_3$ |

TABLE 5-continued
| | | | |
|---|---|---|---|
| 33 | 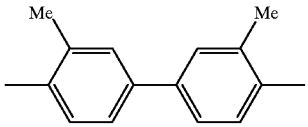 | 1 | —$(CH_2)_2$—COO— —$(CH_2)_3$—Si(OiPr)$_3$ |
| 34 | 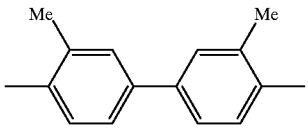 | 1 | —$(CH_2)_2$—COO— —$(CH_2)_3$—Si(OiPr)$_2$Me |
| 35 | 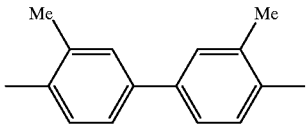 | 1 | —$(CH_2)_2$—COO— —$(CH_2)_3$—Si(OiPr)Me$_2$ |
| 36 | 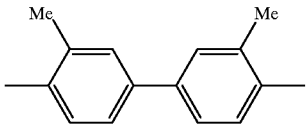 | 1 | —COO—$(CH_2)_3$— —Si(OiPr)$_3$ |
TABLE 6
| No. | $Ar_1$ | $Ar_2$ | $Ar_3$ | $Ar_4$ |
|---|---|---|---|---|
| 37 | 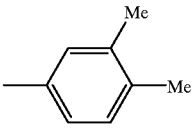 | 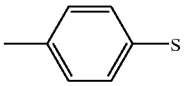 | 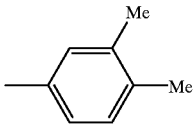 | 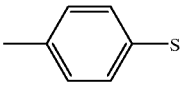 |
| 38 | 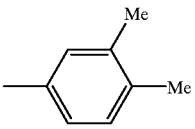 | 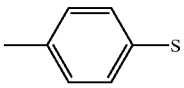 | 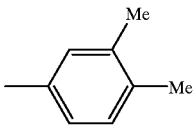 | 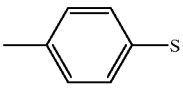 |
| 39 | 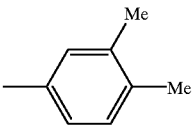 | 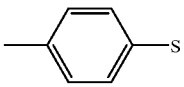 | 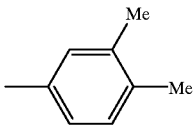 | 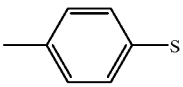 |
| 40 | 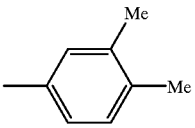 | 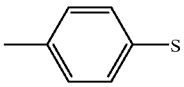 | 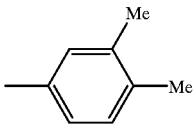 | 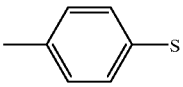 |
| 41 | 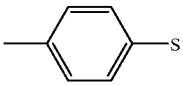 | 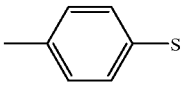 | 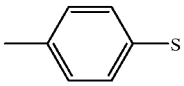 | 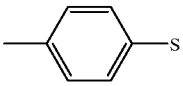 |
| 42 | 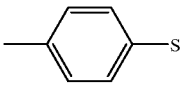 | 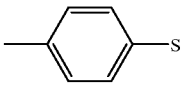 | 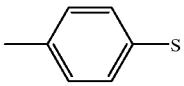 | 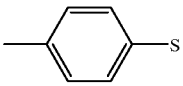 |

TABLE 6-continued
| | | | | |
|---|---|---|---|---|
| 43 | — 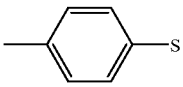 —S | — 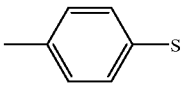 —S | — 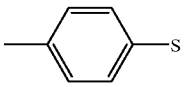 —S | — 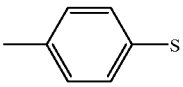 —S |
| 44 | — 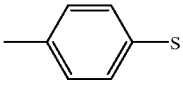 —S | — 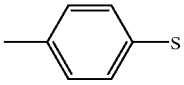 —S | — 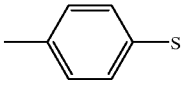 —S | — 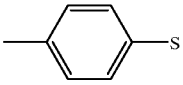 —S |
| No. | $Ar_5$ | k | S |
|---|---|---|---|
| 37 | 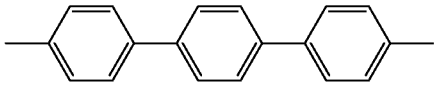 | 1 | $—(CH_2)_4—Si(OiPr)_3$ |
| 38 | 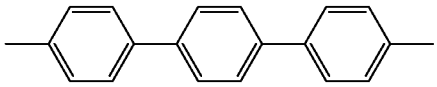 | 1 | $—CH=CH—(CH_2)_2—$ $—Si(OiPr)_3$ |
| 39 | 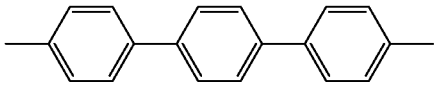 | 1 | $—(CH_2)_2—COO—$ $—(CH_2)_3—Si(OiPr)_3$ |
| 40 | 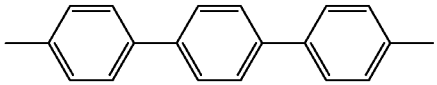 | 1 | $—(CH_2)_2—COO—$ $—(CH_2)_3—Si(OiPr)_2Me$ |
| 41 | 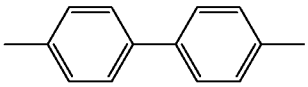 | 1 | $—COO—(CH_2)_3—$ $—Si(OiPr)_3$ |
| 42 | 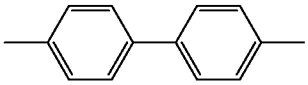 | 1 | $—(CH_2)_2—COO—$ $—(CH_2)_3—Si(OiPr)_3$ |
| 43 | 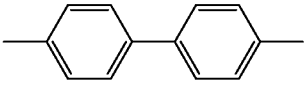 | 1 | $—(CH_2)_2—COO—$ $—(CH_2)_3—Si(OiPr)_2Me$ |
| 44 | 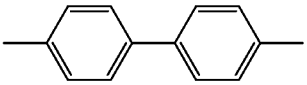 | 1 | $—(CH_2)_2—COO—$ $—(CH_2)_3—Si(OiPr)Me_2$ |
TABLE 7
| No. | $Ar_1$ | $Ar_2$ | $Ar_3$ | $Ar_4$ |
|---|---|---|---|---|
| 45 | — 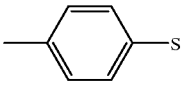 —S | — 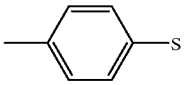 —S | — 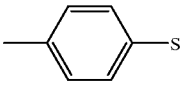 —S | — 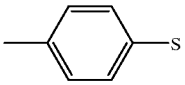 —S |
| 46 | — 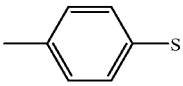 —S | — 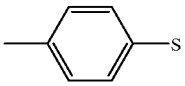 —S | — 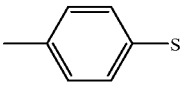 —S | — 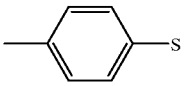 —S |
| 47 | — 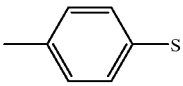 —S | — 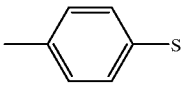 —S | — 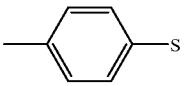 —S | — 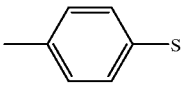 —S |

TABLE 7-continued

| No. | $Ar_5$ | k | S |
|---|---|---|---|
| 48 | 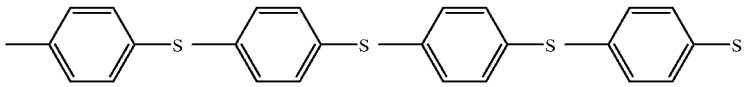 | | |
| 45 | 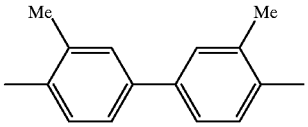 | 1 | —COO—$(CH_2)_3$— —Si(OiPr)$_3$ |
| 46 | 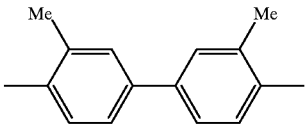 | 1 | —$(CH_2)_2$—COO— —$(CH_2)_3$—Si(OiPr)$_3$ |
| 47 | 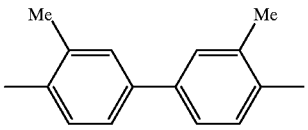 | 1 | —$(CH_2)_2$—COO— —$(CH_2)_3$Si(OiPr)$_2$Me |
| 48 | 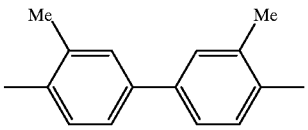 | 1 | —$(CH_2)_2$—COO— —$(CH_2)_3$Si(OiPr)Me$_2$ |

The following description will discuss examples of synthesizing processes of exemplified compound No. 21 of Table 3 and exemplified compound No. 33 of Table 5.

*Example of synthesizing processes of exemplified compound No. 21.

To a 1-liter three-neck round-bottomed flask with a stirrer were loaded 100 g of triphenylamine derivative-1 represented by the following structural formula, 120.3 ml of DMF (dimethylformamide) and 144.1 ml of oxychloride phosphor in a nitrogen gas atmosphere, and this was stirred at 100° C. for four days.

After confirming the completion of the reaction by TLC (thin-layer chromatography), the reaction solution was cooled off in water with ice. 300 ml of distilled water and 300 ml of toluene were added to the reaction solution, and stirred. Thereafter, the reaction solution was toluene-extracted, and the organic layer was washed with distilled water and 10% $K_2CO_3$ solution. The resultant organic layer was subjected to an azeotropic dehydration process by using activated clay, and the activated clay was then removed through filtration. Moreover, this was refined through a silica gel column chromatography (developing solvent: toluene), and the solvent was distilled and removed under a reduced pressure; thus, 111.6 g of bisformyl derivative-1 represented by the following structural formula was obtained.

To a round-bottomed flask were loaded 110 g of diethylphosphono ethylacetate, 500 ml of THF (tetrahydrofuran), 42.5 g of potassium carbonate and 46.2 g of the bisformyl derivative-1 in a nitrogen atmosphere, and this was refluxed under heat for 21 hours. After confirming the completion of the reaction by TLC, the reaction solution was cooled to room temperature, and to this was added 1 ml of distilled water, and then stirred. Thereafter, the reaction solution was toluene-extracted, and the organic layer was washed with distilled water, and then dried with sodium sulfuric anhydride. The solvent of the resultant organic layer was distilled and removed under a reduced pressure, and 57.3 g of an oily substance was obtained.

To a round-bottomed flask were added 57.3 g of the oily substance, 700 ml of $CH_3OH$, 700 ml of THF and 1 g of 10%-Pd/C, and this was hydrogen-substituted, and then stirred for 3 days. After confirming the completion of the reaction by NMR, Pd/C was removed through celite filtration. The solvent was distilled and removed to obtain 56.8 g of an oily substance under a reduced pressure.

To 56.8 g of the oily substance were further added 700 ml of THF, 400 ml of distilled water and 23 g of NaOH, and this was refluxed for 2.5 hours. After confirming the completion of the reaction by TLC, the reaction solution was cooled to room temperature, and then neutralized by adding 1 mol/l of HCl until the number of pH had reached approximately 4. The resultant solid matter was filtrated, and dried to obtain 49.3 g of a carboxylate derivative-1 represented by the following structural formula.

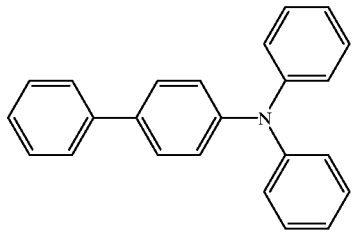

Triphenylamine derivative-1

-continued

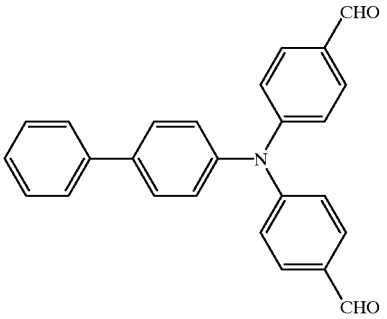

Bisformyl derivative-1

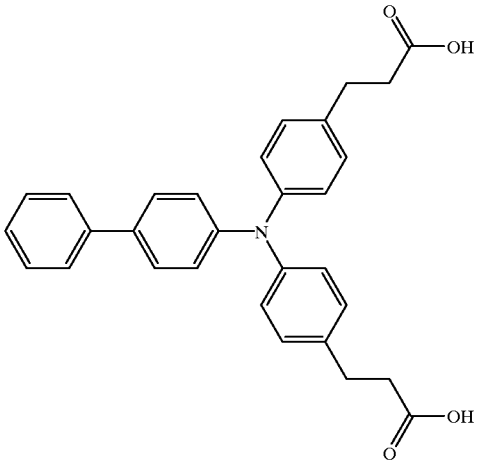

Carboxylate derivative-1

To a three-neck round-bottomed flask were added 25 g of potassium carbonate, 1 liter of DMF, 40 g of carboxylate derivative-1 and 64 g of iodopropyltriisopropoxy silane under a nitrogen gas flow, and this was stirred at 90° C. for three hours. After the reaction solution was cooled off until it had reached room temperature, 1 liter of ethylacetate was added, and insoluble components were filtrated and separated. Thereafter, the insoluble components were washed twice with two liters of distilled water, and the organic layer was dried by using sodium sulfuric anhydride. After the solvent had been distilled and removed under a reduced pressure, this was refined through a silica gel column gas-chromatography (solvent: toluene) to obtain 63 g of compound 21 (a fluorescent light yellow oily substance).

*Example of a synthesizing process of sample compound No. 33

To a 1-liter three-neck round-bottomed flask with a stirrer were loaded 100 g of bisformyl derivative-2 represented by the following structural formula in a nitrogen gas atmosphere, and this was dissolved in 2 liters of toluene. To this were further added 77.4 g of malonic acid and 73.2 ml of piperidine, and this was heated and refluxed for 16 hours. After confirming the completion of the reaction by TLC, the reaction solution was cooled to room temperature, and to this was added two liters of a methanol solution in which 60 ml of concentrated sulfuric acid had been dissolved, and heated and refluxed for 6 hours. Thereafter, the reaction solution was toluene-extracted, and the resultant organic layer was washed with distilled water and 10% $K_2CO_3$ solution. The resultant organic layer was subjected to an azeotropic dehydration process by using activated clay, and the activated clay was then removed through filtration. The solvent was distilled and removed under a reduced pressure to obtain oily substance.

The oily substance obtained in the above-mentioned method was dissolved in a mixed solution formed by mixing 1.5 liters of toluene and 1 liter of methanol, and to this was added 1 g of 10%-Pd/C, and this was hydrogen-substituted, and stirred for three days. After confirming the completion of the reaction by NMR, the Pd/C was removed through celite filtration. The solvent was distilled and removed under a reduced pressure, and this was then re-crystallized (solvent: acetone/methanol) to obtain 84 g of white crystal.

Further, 84 g of the white crystal was dissolved in 1 liter of THF, and to this were added 400 ml of distilled water and 20 g of NaOH, and this was heated and refluxed for 2.5 hours. After confirming the completion of the reaction by TLC, the reaction solution was cooled to room temperature, and then neutralized by adding 1 mol/l of HCl until the number of pH had reached approximately 4. The resultant solid matter was filtrated, and dried to obtain 83 g of a carboxylate derivative-1 represented by the following structural formula.

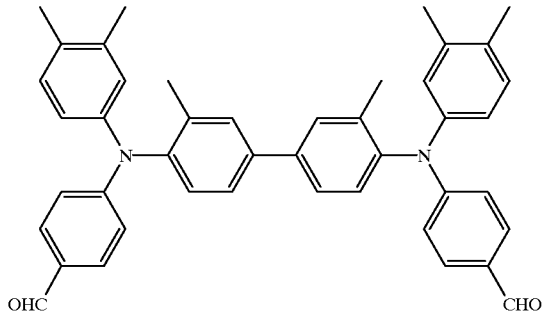

Bisformyl derivative-2

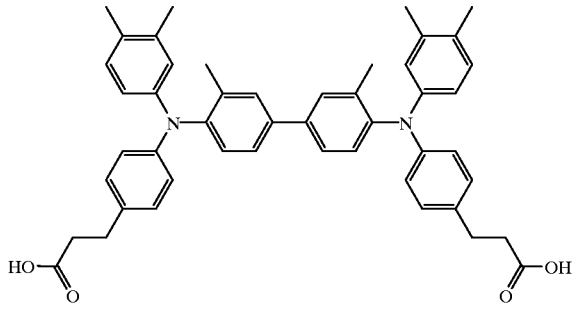

Carboxylate derivative-2

To a three-neck round-bottomed flask were added 22 g of potassium carbonate, 1 liter of DMF, 50 g of carboxylate derivative-2 and 54 g of iodopropyltriisopropoxy silane under a nitrogen gas flow, and this was stirred at 90° C. for three hours. After the reaction solution was cooled to room temperature, 1 liter of ethylacetate was added, and insoluble components were filtrated and separated. Thereafter, the insoluble components were washed twice with two liters of distilled water, and the organic layer was dried by using sodium sulfuric anhydride. After the solvent had been distilled and removed under a reduced pressure, this was refined through a silica gel column chromatography (solvent: toluene) to obtain 70 g of compound 33 (a fluorescent light yellow oily substance)

(2) Inorganic material precursor

Examples of to the inorganic material precursor used in the present invention include various silane coupling agents and commercially available silicon hard coating agent are listed. However, the present invention is not intended to be limited thereby.

More specifically, examples of the silane coupling agent include: tetra-functional alkoxysilane such as tetramethoxysilane and tetraethoxysilane; tri-functional alkoxysilane, such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropyltrimethoxysilane, γ-aminopropyltriethoxysilane, γ-aminopropyltrimethoxysilane and N-β(aminoethyl) γ-aminopropyltriethoxysilane; and difunctional alkoxysilane such as γ-glycidoxypropylmethyldiethoxysilane, γ-aminopropylmethyldimethoxysilane, dimethyldimethoxysilane and diphenyldimethoxysilane. Moreover, with respect to commercially available hard coating agents, specific examples include KP-85, X-40-9740, X-40-2239 (made by Shinetsu Silicon K.K.) and AY42-440, AY42-441 and AY49-208 (made by Dow Corning Toray Silicone Company, LTD.).

Moreover, preferable examples of inorganic material precursors include those represented by the following formula (III):

$$B—[A]_n \qquad \text{(III)}$$

(In formula (III), A represents a substitutional silicon group having a hydrolytic group represented by $—Si(R^1)_{(3-a)}Q_a$, $R^1$ represents a hydrogen atom, an alkyl group, or a substituted or unsubstituted aryl group, B represents at least one selected from the group consisting of an n-valent hydrogen carbide group that may include a sub-chain, n-valent phenyl group, —NH— and —O—Si—. a is an integer of 1 to 3, and n is an integer of not less than 2).

Examples of inorganic material precursor preferably include those shown in Table 8; however, the present invention is not intended to be limited thereby.

TABLE 8

| No. | Structural formula |
|---|---|
| III-1 | $(MeO)_3Si—(CH_2)_2—Si(OMe)_3$ |
| III-2 | $(EtO)_3Si—(CH_2)_2—Si(OEt)_3$ |
| III-3 | $(MeO)_2bMeSi—(CH_2)_2—SiMe(OMe)_2$ |
| III-4 | $(MeO)_3Si—(CH_2)_6—Si(OMe)_3$ |
| III-5 | $(EtO)_3Si—(CH_2)_6—Si(OEt)_3$ |
| III-6 | $(MeO)_2MeSi—(CH_2)_6—SiMe(OMe)_2$ |
| III-7 | $(MeO)_3Si—(CH_2)_3—NH—(CH_2)_3—Si(OMe)_3$ |
| III-8 | $(MeO)_3Si—(CH_2)_3—NH—(CH_2)_2—NH—(CH_2)_3—Si(OMe)_3$ |
| III-9 | 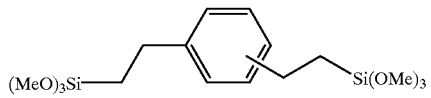  |
| III-10 | 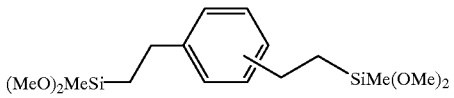  |
| III-11 | 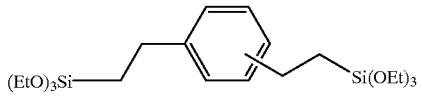  |
| III-12 | 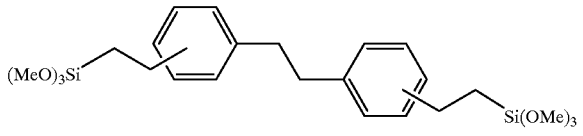  |
| III-13 | 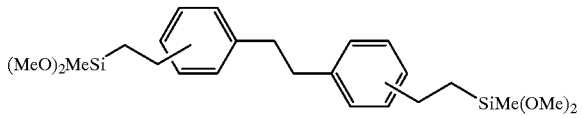  |

TABLE 8-continued

| No. | Structural formula |
|---|---|
| III-14 | 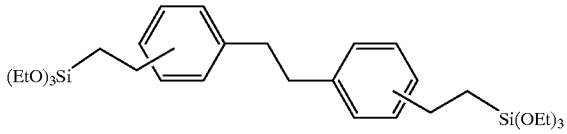 |
| III-15 | $(MeO)_3SiC_3H_6$—O—$CH_2CH$[—O—$C_3H_6Si(OMe)_3$]—$CH_2$[—O—$C_3H_6Si(OMe)_3$] |
| III-16 | $(MeO)_3SiC_2H_4$—$SiMe_2$—O—$SiMe_2$—O—$SiMe_2$—$C_2H_4Si(OMe)_3$ |

[2] Manufacturing methods of silicon-containing coating agent and electronic device The manufacturing method of the silicon-containing coating agent of the present invention is provided with the steps of: preparing at least two kinds of hydrolytic silicon compounds that are different in reactivity to water; preparing a protective group precursor having a substituent having a reactivity to water equal or substantially equal to the reactivity of a reactive group of one of the hydrolytic silicon compounds to water; exchanging a reactive group of the other hydrolytic silicon compound with the substituent of the protective group precursor, thereby making the reactivity of the other hydrolytic silicon compound to water equal or substantially equal to the reactivity of the one of the hydrolytic silicon compounds to water; and allowing said hydrolytic silicon compounds to partially react with each other by commonly hydrolyzing them in the state in which they are equal or substantially equal.

More specifically, a functional organic silicon compound that is a hydrolytic silicon compound is mixed with a protective group precursor (a precursor having a substituent having a reactivity to water equal or substantially equal to a reactivity of a reactive group of an inorganic material precursor to water) solely or together with the inorganic material precursor that is a hydrolytic silicon compound, and a protective group exchanging catalyst is added to this, if necessary, and stirred. The protective group precursor reacts with the reactive group (substituent) in the functional organic silicon compound, and carries out an exchanging reaction on the substituent so that the reactive group having a low reactivity in the functional organic silicon compound is exchanged with a reactive group (hydrolytic substituent) having a high reactivity. Consequently, it is possible to form a functional organic silicon compound whose reactivity is the equal or substantially equal to that of the inorganic material precursor having a high reactivity to water (reactivity to a hydrolyzing reaction).

In order to make the reactivity of the functional organic silicon compound and the inorganic material precursor the same or substantially the same, the reactive group of the functional organic silicon compound is exchanged with a reactive group that is the same kind as that of the inorganic material precursor. However, this may be exchanged with a reactive group that is a different kind, as long as the reactivity is finally equal or substantially equal in the end. Here, in the present invention, the definition that "reactivity is substantially equal" refers to a state in which the reactivity is cause to be about the same such that no deposition, cloud, etc. appear upon carrying out a common hydrolyzing process.

Examples of the hydrolytic substitute include, a chlorosilyl group, an alkoxysilyl group, an acetoxysilyl group, an enoxysilyl group, an aminosilyl group, etc.; and among these, the alkoxysilyl group is most commonly used. The reactivity of the alkoxysilyl group to hydrolysis is derived from the number of carbon atoms in the alkoxy group, and it has been known that the smaller the number of carbon atoms, the higher the reactivity to hydrolysis.

Here, an explanation will be given by giving as an example, a case in which the alkoxysilyl group is used as the hydrolytic substitute. In this case, the protective group precursor refers to alcohol, and by using alcohol having a small number of carbon atoms, it is possible to exchange a reactive group having a low reactivity with a reactive group having a high reactivity (hydrolytic property). In contrast, when alcohol having a greater number of carbon atoms is used, it is possible to exchange to a reactive group having a low reactivity. Specific examples of alcohol having a small number of carbon atoms include methanol, ethanol, etc., and specific examples of alcohol having a great number of carbon atoms include propanol, isopropanol, butanol, etc. When consideration is given to the efficiency of a curing reaction at the time of application of a coating agent, it is preferable to use a protective group precursor having a small number of carbon atoms, such as, in particular, those of primary alcohol. However, any desirable protective group precursor may be used.

The amount of addition of the protective group precursor is preferably set to 1 to 1000 times the number of the reactive groups to be exchanged, more preferably, to 2 to 10 times. An amount less than 1 time fails to complete the exchange of the reactive groups, and the amount exceeding 1000 times results in a reduction in the viscosity of the coating solution.

Examples of the catalyst (protective group exchanging catalyst) that is used as needed at the time of application of the protective group precursor, include: inorganic acids such as hydrochloric acid, acetic acid, sulfuric acid and phosphoric acid; organic acids, such as formic acid, propionic acid, oxalic acid, paratoluene sulfonic acid, benzoic acid, phthalic acid and maleic acid; alkali catalysts, such as potassium hydroxide, sodium hydroxide, calcium hydroxide and ammonia; organic metal; metal alkoxide; for example, organic tin compounds such as dibutyltindilaurylate, dibutyltindioctyate and dibutyltindiacetate; metal chelate compounds, such as aluminumtris(acetylacetonate), titaniumtetrakis(acetylactonate), titaniumbis(butoxy)bis(acetylacetonate), titaniumbis(isopropoxy)bis(acetylacetonate), zirconiumtetrakis (acetylacetonate), zirconiumbis(butoxy)bis(acetylacetonate) and zirconiumbis(isopropoxy)bis(acetylacetonate); boron compounds such as boronbutoxide and boric acid.

Moreover, examples of the solid catalyst virtually insoluble to the reaction solution in which the exchange is carried out include: cation exchange resins, such as Amber lite 15, Amber lite 200C, Amber lyst 15, Amber lyst 15E (made by Rohm and Haas Co.); DowX MWC-1-H, DowX88, DowX HCR-W2 (made by Dow Chemical Corp.), Levachitt SPC-108, Levachitt SPC-118 (made by Bayer Corp.), Diaion RCP-150H (made by Mitsubishi Kasei K.K.), Sumika Ion KC-470, Duolite C26-C, Duolite C-433, Duolite-464 (made by Sumitomo Kagaku K.K.), and Naphion-H (made by Du Pont Corp.); anion exchanging resins, such as Amber lite IRA-400 and Amber lite IRA-45 (made by Rohm and Haas Corp.); inorganic solid matters having a surface to which are bonded groups containing a proton acid group such as Zr $(O_3PCH_2CH_2SO_3H)_2$, and $Th(O_3PCH_2CH_2COOH)_2$; hetero polyacids such as polyorganosiloxane containing proton acid groups such as polyorganosiloxane having a sulfone acid group, cobalt tungsten acid and phosphate molybdic acid; isopolyacids such as niobic acid, tantalic acid and, molybdic acid; metal oxides of mono-element type such as silica gel, alumina, chromia, zirconium, CaO and MgO; composite metal oxides such as silica-alumina, silica-magnesia, silica-zirconia, and zeolite; clay minerals such as acidic clay, activated clay, montmorillonite and kaolinite; metal sulfates such as $Li_2SO_4$ and $MgSO_4$; metal phosphates such as zirconium phosphate and lanthanum phosphate; metal nitrates such as $LiNO_3$ and $Mn(NO_3)_2$; inorganic solid matters having a surface to which are bonded groups containing amino groups, such as a solid matter obtained by allowing aminopropyltriethoxysilane to react on silica gel; and polyorganosiloxane containing amino groups such as an amino-modified silicon resin. The above-mentioned catalysts may also be used as catalysts for hydrolysis, which will be described later.

Moreover, other catalysts may be used, which include: metal catalysts such as Pd/C and Raney nickel; trichloromethylsilane, and tetrachlorosilane; and halogenated silanes such as halogenated silane which reacts with the protective group precursor to form an inorganic material precursor in the coating agent component.

From the viewpoint of storage stability, charactaristics, and strength, etc., the amount of the catalyst to be used is preferably set to 0.1 to 20 wt %, more preferably, to 0.3 to 10 wt %, with respect to the total amount of the materials containing the hydrolytic substitute. Here, in the case when a solid catalyst that is virtually insoluble to the reaction solution in which the exchange is carried out is used, since the matter is easily removed from the solution after the completion of the reaction, the amount thereof is not particularly limited. Moreover, when a catalyst, which can be used as the catalysts for both the hydrolysis and for the exchanging reaction to the protective group, is adopted, it is possible to simplify the processes, and also to stabilize the coating solution.

Moreover, in order to impart water repellency, etc., the following materials may be added thereto: silane coupling agents, such as (tridecafluoro-1,1,2,2-tetrahydrooctyl) triethoxysilane, (3, 3, 3-trifluoropropyl)trimethoxysilane, 3-(heptafluoroisopropoxy) propyltriethoxysilane; and fluorine-containing compounds, such as 1H, 1H, 2H, 2H-perfluoroalkyltriethoxysilane, 1H, 1H, 2H, 2H-perfluorodecyltriethoxysilane, and 1H, 1H, 2H, 2H-perfluorooctyltriethoxysilane. A desired amount of silane coupling agent may be used; however, regarding of the amount of fluorine-containing compounds, it is preferable to set the amount to not more than 0.5 wt % with respect to non-fluorine-containing compounds. The amount exceeding 0.5 wt % tends to cause a problem with the film-forming property of the cross-linked film.

Here the completion of the exchanging reaction of the reactive group may be confirmed by various analytic methods; and methods such as NMR, TLC (Thin Layer Chromatography), etc., may be preferably used. In particular, the application of the TLC method makes it possible to easily check the dissipation of the functional organic silicon compound.

The exchange of the reactive group may be carried out without the application of a solvent; however other commonly-used solvents may be used as in the case of the protective group precursor. In particular, it is preferable to use the protective group precursor as the solvent, since this makes it possible to prevent side reactions. Moreover, the protective group precursor and the solvent may be dehydrated before application; thus, it becomes possible to prevent the reactive group from being hydrolyzed during the exchanging reaction of the reactive group.

Moreover, in order to regulate the hydrolysis of reactive group during the exchanging reaction, drying agents such as calcium chloride, sodium sulfate, magnesium sulfate and calcium sulfate, and dehydrating agents, such as orthoformic acid methylorthoformic acid ethyl, orthoacetic acid ethyl, orthopropionic acid methyl and orthopropionic acid ethyl, may be used.

After the process in which the reactivity of the above-mentioned at least two kinds of hydrolytic silicon compounds have been made equal or substantially equal to each other, in the case when the inorganic material precursor had not been mixed thereto, it is mixed thereto, and a hydrolyzing catalyst is added, if necessary, so that the functional organic silicon compound and the inorganic material precursor are commonly hydrolyzed. With respect to the hydrolyzing catalyst, the same catalyst as the catalyst used in the exchange of the reactive group may be used; however, from the viewpoint of easiness in operation and stability in the coating solution, it is preferable to use a solid catalyst virtually insoluble to the reaction solution in which hydrolysis takes place, such as metal chelate compounds. Moreover, with respect to the amount of the catalyst to be used, it is preferable to set the amount in the same range as the amount of the catalyst used in the exchanging reaction of the reactive group.

In the manner as described above, the silicon-containing coating agent is manufactured. The silicon-containing coating agent, thus manufactured, is applied onto a desired base plate surface. With respect to the coating method, the following commonly-used methods may be used: blade coating method, wire bar coating method, spray coating method, dip coating method, bead coating method, air-knife coating method, curtain coating method, etc. The thickness of the film may be desirably set.

After the silicon-containing coating agent has been applied onto the base plate surface, this is heated so that the coated film is cured to form a cured film. The curing temperature (heating temperature), which may b e desirably determined, is preferably set in the range of 60° C. to 200° C., more preferably, 80° C. to 170° C. to obtain a desired hardness. The curing time, which may be desirably set as neccessary, is preferably set in the range of 10 minutes to 5 hours. Moreover, after the curing reaction has been carried out, the cured film may be placed in a highly moistened state; this is effective since the characteristics are stabilized. Moreover, depending on the usage, a surface treatment may be applied thereto by using hexamethyldisilazane or trimethylchlorosilane, etc. so to as to impart hydrophobicity.

As described above, the functional organic silicon compound and the inorganic material precursor are preliminarily commonly hydrolyzed , and then applied onto the surface of a base plate, etc., and cured thereon; thus, it becomes possible to manufacture an electronic device of the present invention which is superior in durability, stability and function.

Examples of the electronic devices of the present invention include: electrophotographic photoreceptors, organic EL elements, solar batteries, organic conductors, electrophotographic carriers, charge generation materials, etc. The silicon-containing coating agent, used in the formation of the cured film on the electronic devices, may be applied to coating agents for electrophotographic carriers, a surface treatment for charge generation materials, an intermediate layer between aluminum, nickel, nesaglass, etc. and an organic photosensitive layer, and in particular, the application of the coating agent to the formation of a cured film for electrophotographic photoreceptors makes it possible to achieve superior characteristics.

In the case of electrophotographic photoreceptors that are one example of the electronic device, an electrophotographic photoreceptor of a laminated type, which has been mainly used, is generally provided with a charge transport layer on its uppermost layer, and along with demands for high speeds and miniaturization in the device in which it is installed, not only cost reduction, but also high durability of the uppermost surface layer, has to be achieved. Here, when the cured film, which is formed by using the above-mentioned silicon-containing coating agent in which the material having a low reactivity to hydrolysis is used as an organic silicon-modified positive-hole carrier compound, is formed as the uppermost layer, it becomes possible to greatly cut costs and also to achieve high durability since the above-mentioned exchanging process of the reactive group has been applied. Hereinafter, an explanation will be given of an electrophotographic photoreceptor that is one example of electronic devices manufactured by using the silicon-containing coating agent.

[B] Electrophotographic photoreceptor

The electrophotographic photoreceptor of the present invention, which is an electrophotographic photoreceptor having one or more layers of the cured film formed by applying a silicon-containing coating agent to a surface of a base plate to be cured thereon, and the silicon-containing coating agent has an arrangement in which: at least two kinds of hydrolytic silicon compounds that are different in reactivity to water are prepared; a protective group precursor having a substituent having a reactivity to water equal or substantially equal to the reactivity of a reactive group of one of the hydrolytic silicon compounds to water is prepared; a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water; and a silicon-containing coating agent containing the one of the hydrolytic silicon compounds and a hydrolytic silicon compound having the reactive group which has been exchanged with the substituent of the protective group precursor is prepared.

Moreover, the electrophotographic photoreceptor of the present invention is preferably provided with the cured film formed by applying the silicon-containing coating agent to the base plate to be cured thereon, as the uppermost surface layer.

For example, in the case when the electrophotographic photoreceptor of the present invention is of a stacked layer type having an arrangement in which: a conductive support member (1) of aluminum, etc., is prepared as a base plate, a undercoat layer (2) is formed on the surface thereof, and a charge generating layer (3), a charge transport layer (4), and a surface protective layer (5) are successively formed thereon, the application of the cured film formed by applying the silicon-containing coating agent to be cured as the charge transport layer and the surface protective film makes it possible to manufacture an electrophotographic photoreceptor that is superior in durability. In particular, in the case when it is used as the surface protective layer that is the uppermost layer, this application is further preferable since it is possible to obtain superior durability. Moreover, since silicon-containing coating agent provides a superior dispersing property for fine particles, fine particles can be maintained in a highly dispersed state. Here, an explanation will be given of the electrophotographic photoreceptor of the present invention (hereinafter, sometimes referred to simply as "photoreceptor"), by using the above-mentioned stacked layer type photoreceptor as an example.

(1) Conductive support member

Examples of the conductive support member, include: a metal plate, a metal drum and a metal belt made of metal and alloys thereof, such as aluminum, copper, zinc, stainless, chromium, nickel, molybdenum, vanadium, indium, gold and platinum; conductive compounds such as conductive polymers and indium oxide; and paper, a plastic film and a belt on which metal or alloy, such as aluminum, palladium and gold, is applied, vapor deposited, or laminated. Moreover, if necessary, the surface of the conductive support member may be subjected to various treatments as long as there is no adverse effect on the image quality. For example, the surface may be subjected to processes such as an anodic oxidation coating process, a hot-water oxidation process, a chemical treatment and a coloring process, or an irregular reflection treatment, etc. by using sand blasting.

(2) Base layer

The undercoat layer is placed between the conductive support member and the charge generating layer which will be described later, if necessary. The application of the undercoat layer makes it possible 1) to prevent unnecessary carriers from being injected from the conductive support member, and consequently to improve the image quality, and also 2) to prevent the photoreceptor from raising environmental fluctuations in the light diminishing line, and consequently to provide stable image quality. Moreover, the undercoat layer has 3) a proper charge carrying ability so that it is free from charge accumulation even after long term, repeated use, thereby causing no sensitivity fluctuations, and also has 4) a proper voltage resistance against a charging voltage so that it is free from image loss due to dielectric breakdown. Moreover, it serves as 5) a bonding layer for integrally bonding and maintaining the photosensitive layer to the support member, and provides 6) a light reflection preventing function for light directed to the conductive support member, depending on the case.

The undercoat layer is mainly composed of a binder resin, and specific examples of the binder resin include: polyamide resin, vinyl chloride resin, vinyl acetate resin, phenolic resin, polyurethane resin, melamine resin, benzoguanamine resin, polyimide resin, polyethylene resin, polypropylene resin, polycarbonate resin, acrylic resin, methacrylic resin, vinylidenechloride resin, polyvinylacetal resin, vinylchloride-vinylacetate copolymer, polyvinylalcohol resin, water-soluble polyester resin, etc. Moreover, in place of the binder resin, or together with the binder resin, the following known materials may be used: nitrocellulose, casein, gelatin, polyglutamic acid, starch, starch acetate, aminostarch, polyacrylic acid, polyacrylamide, zirconium chelate compounds, titanyl chelate compounds, titanyl alkoxide compounds, organic titanyl compounds, silane coupling agents, etc.

The undercoat layer, which is formed on the surface of the conductive support member as necessary, is formed by dissolving and dispersing the above-mentioned binder resin, etc. in an appropriate solvent, and applying this by the following commonly-used methods: blade coating method, wire bar coating method, spray coating method, dip coating method, bead coating method, air-knife coating method, curtain coating method, etc. The thickness of the undercoat layer is preferably set in the range of 0.01 to 10 μm, preferably, 0.05 to 2 μm.

Moreover, the undercoat layer may be formed by using the silicon-containing coating agent of the present invention. In this case, fine particles of titanium oxide, aluminum oxide, silicon oxide, zirconium oxide, barium titanate, silicone resin, etc. may be mixed into the silicon-containing coating agent.

(3) Charge generating layer

In general, a charge generating layer is formed on the surface of the conductive support member (on the undercoat layer, if it is formed thereon). The charge generating layer contains at least a charge generating material. Examples of the charge generating material used in the charge generating layer include: organic pigments, such as azo pigments, quinone pigments, condensed ring aromatic pigments, perylene pigments, indigo pigments, thioindigo pigments, bisbenzoimidazole pigments, phthalocyanine pigments, quinacridone pigments, quinoline pigments, lake pigments, azolake pigments, anthraquinone pigments, oxazine pigments, dioxazine pigments and triphenylmethane pigments; various dyes, such as azulenium dyes, squalium dyes, pyrylium dyes, triallylmethane dyes, xanthene dyes, thiazine dyes and cyanine dyes; inorganic materials, such as amorphous silicon, amorphous selenium, tellurium, selenium-tellurium alloy, cadmium sulfide, antimony sulfide, zinc oxide and zinc sulfide. Among these, condensed ring aromatic pigments, perylene pigments and azo pigments are preferably used from the viewpoint of the sensitivity, electrical stability and photochemical stability with respect to irradiated light. With respect to the charge generating material, these listed above may be used alone, or not less than two kinds of them may be mixed and used combinedly.

The charge generating layer is formed by vapor-depositing the above-mentioned charge generating material through a vacuum vapor deposition method. Alternatively, a coating solution is prepared by dissolving and dispersing the binder resin and the charge generating material in a solvent, and this coating solution may be applied so as to form the charge generating layer.

In the case of the coating solution, examples of the binder resin used for the charge generating layer include: polyvinyl acetal resins such as a partially acetalized polyvinyl acetal resin in which one portion of butyral is modified by formal and acetoacetal, polyamide resin, polyester resin, modified ether type polyester resin, polycarbonate resin, acrylic resin, polyvinyl chloride resin, polyvinylidene chloride resin, polystyrene resin, polyvinylacetate resin, vinylchloride-vinylacetate copolymer, silicone resin, phenolic resin, phenoxy resin, melamine resin, benzoguanamine resin, urea resin, polyurethane resin, poly-N-vinylcarbazole resin, polyvinylanthoracene resin, polyvinylpyrene resin, etc. Among these, in particular, polyvinylacetal resin, vinylchloride-vinylacetate copolymer, phenoxy resin and modified ether type polyester resin are superior in dispersing the charge generating material, thereby making the coating solution (dispersed coating liquid) stable for a long time without coagulation.

A uniform coat film is formed by using such a coating solution so that the electrical characteristics are improved and defects in the image quality can be minimized. However, the present invention is not intended to be limited by the above-mentioned materials; and any resin may be used as long as it forms a coat film in a normal state. These binder resins may be used alone, or not less than two kinds of these may be mixed combinedly. The blending ratio of the charge generating material and the binder resin is preferably set in the range of 5:1 to 1:2 in volume ratio.

Moreover, examples of the solvent used at the time of preparation of the above-mentioned coating solution include the following commonly-used organic solvents which are used alone, or in combination of not less than two kinds: methanol, ethanol, n-propanol, n-butanol, benzyl alcohol, methylcellosolve, ethylcellosolve acetone, methylethylketone, cyclohexane, chlorobenzene, methylacetate, acetate-n-butyl, dioxane, tetrahydrofuran, methylene chloride, chloroform, etc.

Examples of the application method of the coating solution include the following commonly-used methods: blade coating method, wire bar coating method, spray coating method, dip coating method, bead coating method, air-knife coating method, curtain coating method, etc. The thickness of the charge generating layer is preferably set in the range of 0.01 to 5 μm, more preferably, 0.1 to 2.0 μm. The layer thinner than 0.01 μm fails to uniformly form the charge generating layer, and the layer exceeding 5 μm causes extreme degradation in the electrophotographic characteristics.

Moreover, a stabilizing agent such as an antioxidant and a deactivation agent maybe added to the charge generating layer. Examples of the antioxidant, include: phenolic, sulfuric, phosphoric, or amine compounds. Examples the deactivation agent include bis(dithiobenzyl)nickel, di-n-butylthiocarbamic acid nickel, etc.

(4) Charge transport layer

The charge transport layer is preferably formed by a method in which the cured film, formed by applying and curing the silicon-containing agent in the present invention, is placed alone, or in combination with the following charge transporting material, binder resin and various additive agents applied thereto on demand. In the case when a surface protective layer is formed on the charge transport layer, the surface protective layer may be formed by the following charge transporting material, binder resin and various additive agents added thereto as necessary, in the same manner as the commonly-used charge transport layer.

Examples of low-molecular compounds for the charge transportingmaterial, include: pyrene, carbazole, hydrazone, oxazole, oxadiazole, pyrazoline, arylamine, arylmethane, benzidine, thiazole, stilbene, or butadiene compounds, triphenylamine compounds and triphenylmethane compounds. Moreover, examples of high-molecular compounds include: poly-N-vinylcarbazole, poly-N-vinylcarbazole halide, polyvinylpyrene, polyvinylanthoracene, polyvinylacridine, pyrene-formaldehyde resin, ethylcarbazole-formaldehyde resin, triphenylmethane polymer, polysilane, etc. Among these triphenylamine compounds, triphenylmethane compounds and benzidine compounds are preferably used from the viewpoint of mobility, stability and light transparency.

The charge transport layer may be formed by using the cured film obtained by applying and curing the silicon-containing coating agent in the present invention, or may be formed by mixing the silicon-containing coating agent with the above-mentioned charge transporting material and binder resin. In the case of the mixed composition, the compounding ratio (weight ratio) of the charge transporting material and the silicon-containing coating agent is preferably set in the range of 10:1 to 1:5.

In the case when a binder resin is used in the charge transport layer, a polymer which can form an electrically insulating film is preferably used. Examples of such a polymer include: polycarbonate resin, polyester resin, methacrylic resin, acrylic resin, polyvinylchloride, polyvinylidene chloride, polystyrene, polyvinylacetate, styrene-butadiene copolymer, vinylidene chloride-acrylonitrile copolymer, vinylchloride-vinylacetate copolymer, vinylchloride-vinylacetate-maleic anhydride copolymer, silicon resin, silicon-alkydresin, phenolformaldehyde, styrene-alkydresin, poly-N-vinylcarbazole, polyvinylbutyral, polyvinylformal, polysulfone, casein, gelatin, polyvinylalcohol, ethylcellulose, phenolic resin, polyamide, carboxy-methylcellulose, vinylidene chloride polymer latex, polyurethane, etc. However, the present invention is not intended to be limited thereby.

These binder resins are used alone, or not less than two kinds of them are used in combination with each other; and in particular, polycarbonate resin, polyester resin, methacrylic resin and acrylic resin are more preferably used since they are superior in the compatibility with the charge transporting material, solubility in the solvent, and strength.

Moreover, in combination with these binder resins, the following additive agents, such as a plasticizer, surfactant, antioxidant and photo-degradation inhibitor, may be used. Examples of the plasticizer include: biphenyl, biphenyl chloride, tarphenyl, dibutylphthalate, diethyleneglycolphthalate, dioctylphthalate, triphenylphosphate, methylnaphthalene, benzophenone, chlorinated paraffin, polypropylene, polystyrene, various fluoro hydrogen carbides. With respect to the surfactant, silicone oils, such as polydimethylsiloxane and polymethylphenylsiloxane, are listed. With respect to the antioxidant, those of phenolic, sulfuric, phosphoric, and amine compounds are listed. With respect to the photodegradation inhibitor, for example benzotriazole compounds, benzophenone compounds and hindered amine compounds are listed. Here, in the case when the silicon-containing agent of the present invention is not used, the above-mentioned components are dissolved in an appropriate solvent so as to form a coating solution.

Examples of the coating method include the following commonly-used methods: blade coating method, wire bar coating method, spray coating method, dip coating method, bead coating method, air-knife coating method, curtain coating method, etc. Examples of the solvent used for forming the charge transport layer include: aromatic hydrogen carbides such as benzene, toluene, xylene and chlorobenzene; ketones such as acetone and 2-butanone; halogenated aliphatic hydrogen carbides, such as methylene chloride, chloroform and ethylene chloride; tetrahydrofuran; and cyclic or linear ethers such as ethylether. These commonly-used organic solvents are used alone, or not less than two kinds of them may be used in combination.

The thickness of the charge transport layer is preferably set in the range of 5 to 50 $\mu$m, more preferably, 10 to 40 $\mu$m. The thickness less than 5 $\mu$m makes it difficult to charge, and the thickness exceeding 50 $\mu$m tends to cause extreme degradation in the electrophotographic characteristics.

(5) Surface protective layer

The surface protective layer, which is formed, if necessary, is placed on the charge transport layer. The surface protective layer makes it possible to improve the durability. Here, the cured film, formed by applying and curing the silicon-containing coating agent of the present invention, is preferably used as the surface protective layer so as to form a surface layer with higher strength. Moreover, a conductive material and a binding resin may be mixed to the silicon-containing coating agent so as to form the cured film.

In the case when the cured film of the present invention is formed as the surface protective layer, the aforementioned charge transporting material, semi-conductive material and binder resin are added to the silicon-containing coating agent, as necessary, and this is applied to the charge transport layer, and cured thereon.

The binder resin is not particularly limited, as long as it is compatible with the functional organic silicon compound represented by formula (I); and for example, the following known resins may be used: polyamide resin, polyurethane resin, polyester resin, epoxy resin, polyketone resin, polycarbonate resin, polyvinylketone resin, polystyrene resin, polyacrylamide resin, polyimide resin, polyamideimide resin, polyetherimide resin, etc.

In order to increase the strength of the cured film, inorganic fine particles, such as silica and alumina, or organic fine particles, such as PTFE and cross-linked polystyrene, may be added to the silicon-containing coating agent of the present invention. The inorganic fine particles are preferably coated with organic groups, from the viewpoint of the image quality.

Moreover, a lubricant and fine particles, such as silicone oil and fluorine-based materials, maybe added thereto so as to increase the lubricating property and strength. The aforementioned fluorine-containing silane coupling agent, etc. may be preferably used as the lubricant.

Furthermore, with respect to the fine particles to be dispersed, examples thereof include: fluorine-based fine particles, such as ethylene tetrafluoride, ethylene trifluoride, propylene hexafluoride, vinyl fluoride and vinylidene fluoride; fine particles composed of a resin formed by copolymerizing a monomer having a fluorine resin and a hydroxyl group, such as those described in a report in the 8th Polymer Material Forum, p89; and semi-conductive metal oxides such as $ZnO—Al_2O_3$, $SnO_2—Sb_2O_3$, $In_2O_3—SnO_2$, $ZnO—TiO_2$, $ZnO—TiO_2$, $MgO—Al_2O_3$, $FeO—TiO_2$, $TiO_2$, $SnO_2$, $In_2O_3$, ZnO and MgO.

The surface protective layer is formed through a process in which the above-mentioned component is dissolved in an appropriate solvent as necessary, and dispersed therein to form a coating solution, and this is applied. With respect to the coating method, the following commonly-used methods may be used: blade coating method, wire bar coating method, spray coating method, dip coating method, bead coating method, air-knife coating method, curtain coating method, etc. The thickness of the surface protective layer is generally set in the range of 0.1 to 10 $\mu$m, more preferably, 0.5 to 7 $\mu$m.

The solvent used for forming the surface protective layer are preferably solvents which dissolve the material for forming the protective layer, and do not erode the charge transport layer beneath the surface protective layer; and examples thereof include: alcohols, such as methanol, ethanol, propanol, isopropanol, butanol, t-butanol and cyclohexanol; ethers, such as diethylether, dibutylether, dimethoxyethane and diethoxyethane; aromatic solvents such as xylene and p-cymene; and cellsolves such as methylcellsolve and ethylcellsolve. Among these, alcohols having a boiling point of 60 to 150° C. are more preferably used from the viewpoint of the film forming property and storage stability in the coating solution.

[C] Process cartridge

Process cartridges are parts into which, in order to properly replace parts which are used of in an image forming apparatus, some of the constituent parts are incorporated; thus, these cartridges make it possible to easily carry out the replacement processes. The process cartridges are combined into an image-forming apparatus, and traded in this combined state, and each unit is also traded as replacement part or a repairing part.

The process cartridge of the present invention is formed of the aforementioned electrophotographic photoreceptor of the present invention and at least one member selected from the group consisting of a charger, a static eliminator and a cleaning device, and is detachably attached to an image-forming apparatus. The component parts other than the electrophotographic photoreceptor to be incorporated into the process cartridge are not specifically limited, and any of conventionally known parts may be adopted without any problem.

In the case when a photoreceptor having a long service life is incorporated, the process cartridge is preferably provided with a structure that the toner can be easily refilled. For this reason, the toner refilling section is not bonded or fused thereto, but attached with screws or with a clipping system; thus, at the time of refilling toner, the structure allows easy opening and closing without causing any damage to the process cartridge. With this structure, since the refilling process is easily carried out by using a toner bottle, etc., it is possible to cut costs. Since the process cartridge is allowed to have a longer service life, it is possible to reduce the load on the environment.

[D] Image forming apparatus

The image-forming apparatus of the present invention is an image-forming apparatus of the electrophotographic system which is provided with the above-mentioned electrophotographic photoreceptor or a process cartridge including the electrophotographic photoreceptor.

The image-forming apparatus of the present invention is provided with an exposing device composed of a laser optical system and an LED array, a developing device forming images by using toner, etc., a transferring device for transferring a toner image on a recording medium such as paper, a fixing device for fixing the toner image onto the recording medium such as paper, a cleaning device for removing toner, dusts, etc. adhering to the photoreceptor, a static eliminator for eliminating a residual electrostatic latent image from the surface of the photoreceptor, etc., and these devices are well known in the art, and arranged as necessary.

In the image-forming apparatus of the present invention, the charging system is either the non-contact charging system or the contact charging system by means of Corotron or Scorotron which are well known systems; and since the photoreceptor of the present invention has high mechanical strength, its durability is displayed more effectively when used in the contact charging system that applies higher stress to the photoreceptor.

In the contact charging system, a voltage is applied to a conductive member that is in contact with the surface of the photoreceptor so that the surface of the photoreceptor is charged. The shape of the conductive member may be any shape selected from a brush shape, blade shape, pin electrode shape and roller shape, and among these, the roller-shaped member is particularly preferable. The roller-shaped member is composed of a resistance layer, and an elastic layer and a core member supporting the layer, placed from outside to inside. Moreover, a protective layer may be placed on the outside of the resistance layer, if necessary.

The roller-shaped member is rotated at the same peripheral velocity as the photoreceptor by allowing it to contact the photoreceptor without the need of a specific driving means; thus, it functions as a charging means. However, any driving means may be attached to the roller member so that it is rotated at a peripheral velocity different from that of the photoreceptor, and charged.

Examples of the material for the core member include, conductive materials, such as iron, copper, brass, stainless, aluminum and nickel. Moreover, a resin molded member, etc. in which conductive particles are dispersed may also be used.

Examples of materials for the elastic layer include, conductive or semiconductive materials and in general, rubber in which conductive particles or semi -conductive particles are dispersed is used.

Examples of the rubber material s, include: EPDM, polybutadiene, natural rubber, polyisobutylene, SBR, CR, NBR, silicone rubber, urethane rubber, epichlorohydrine rubber, SBS, thermoplastic elastomer, norbornane rubber, phlorosilicone rubber, ethyleneoxide rubber.

Examples of the conductive particles or semi-conductive particles, include: carbon black, metals such as zinc, aluminum, copper, iron, nickel, chromium and titanium, and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO. These materials may be used alone, or not less than two kinds of them may be used in combination.

Examples of the materials for the resistance layer and the protective layer include, those materials in which conductive particles or semi-conductive particles are dispersed in a binder resin so as to control the resistivity. Here, the resistivity is generally set in the range of $10^3$ to $10^{14}$ Ωcm, preferably, $10^5$ to $10^{12}$ Ωcm, and most preferably, $10^7$ to $10^{12}$ Ωcm. The thickness thereof is generally set in the range of 0.01 to 1000 μm, preferably, 0.1 to 500 μm, more preferably, 0.5 μm to 100 μm.

Examples of the binder resin, include: acrylic resin, cellulose resin, polyamide resin, methoxymethylated nylon, ethoxymethylated nylon, polyurethane resin, polycarbonate resin, polyester resin, polyethylene resin, polyvinyl resin, polyacrylate resin, polythiophene resin, polyolefin resins such as PFA, FEP and PET, and styrene-butadiene resin.

Examples of the conductive particles or semi-conductive particles include carbon black, metal and metal oxides and are used in the same manner as the elastic layer. Moreover, an antioxidant such as hindered phenol or hindered amine, a filler such as clay or kaolin, and a lubricant such as silicone oil may be added thereto, if necessary.

The methods for forming these layers include the following methods: blade coating method, wire bar coating method, spray coating method, dip coating method, bead coating method, air-knife coating method, curtain coating method, etc.

In the method for charging the photoreceptor by using the conductive member, a voltage is applied to the conductive member, and the applied voltage is preferably a DC voltage, or a voltage obtained by multiplexing an AC voltage on a DC voltage. The DC voltage is preferably set to a positive or negative voltage in the range of 50 to 2000 V, more preferably, 100 to 1500 V, in accordance with a charging potential required for the photoreceptor. In the case of multiplexing the AC voltage, the peak-to-peak voltage is set in the range of 400 to 1800 V, more preferably, 800 to 1600 V, most preferably, 1200 to 1600 V. The frequency of the AC voltage is set in the range of 50 to 20,000 Hz, more preferably, 100 to 5,000 Hz.

EXAMPLES

The present invention will be explained with reference to Examples hereinafter, in which "part" stands for "part by weight. However, the present invention is not intended to be limited thereby.

Example 1

(1) Preparation of a coating agent

Sample composition No. 28 (2 parts) as a functional organic silicon compound, 2 parts of bistrimethoxysilylhexane as an inorganic material precursor and 2 parts of methanol as a protective group precursor were loaded and mixed sufficiently. Further, to this was added 0.2 parts of an ion exchange resin (Amber lyst 15E), and this was stirred at room temperature (at approximately, 25° C., hereinafter, the same temperature) for two hours. After it had been confirmed that the sample composition No. 28 was eliminated by using TLC (thin-layer chromatography, developing solvent: hexane/ethylacetate=3/1, adsorbent: silica gel), 4 parts of IPA (isopropyl alcohol) and 1.7 parts of distilled water were further added thereto, and stirred for one hour.

Thereafter, the ion exchange resin was filtrated through a simplified filter device using absorbent cotton, and to this was added 0.05 parts of aluminum trisacetylacetonate, and dissolved therein. This was then allowed to stand still at room temperature for 16 hours to obtain coating agent 1-1. Moreover, the product that was allowed to stand still for 40 hours was prepared as coating agent 1-2.

(2) Manufacturing processes of an electrophotographic photoreceptor

A cylindrical aluminum base member having an outer diameter of 30 mm, which had been subjected to a honing process, was prepared. To the surface thereof was applied a solution containing 10 parts of a zirconium compound (trade name: Orgatics ZC540 made by Matsumoto Seiyaku K.K.), 1 part of a silane compound (trade name: A1100 made by Nippon Unicar Co., Ltd.), 40 parts of IPA and 20 parts of butanol through a dip coating method, and this was heated and dried at 150° C. for 10 minutes to form a undercoat layer having a film thickness of 0.1 $\mu$m.

Next, 1 part of chlorogallium phthalocyanine crystal, which served as a charge generating material and which had strong diffraction peaks at Bragg angles (2θ×0.2°) of 7.4°, 16.6°, 25.5° and 28.3° in the X-ray diffraction spectra, was mixed with 1 part of polyvinylbutyral resin (trade name: Eslec BM-S made by Sekisui Chemical Co., Ltd.) and 100 parts of butylacetate. This was then processed by a paint shaker together with glass beads for one hour so as to be dispersed, and the resultant coating solution was dip-coated onto the undercoat layer, and heated and dried at 100° C. for 10 minutes to form a charge generating layer having a film thickness of approximately 0.15 $\mu$cm.

Moreover, a coating solution, which had been obtained by dissolving 2 parts of benzidine compound represented by the following structural formula CTM-1 and 3 parts of bisphenol (Z) polycarbonate resin (viscosity average molecular weight $4.4\times10^4$) into a mixed solvent of 15 parts of monochlorobenzene and 15 parts of tetrahydrofuran, was dip-coated onto the charge generating layer, and heated and dried at 115° C. for one hour to form a charge transport layer having a film thickness of 20 $\mu$m. The photoreceptor thus formed was used as a base photoreceptor 1.

CTM-1

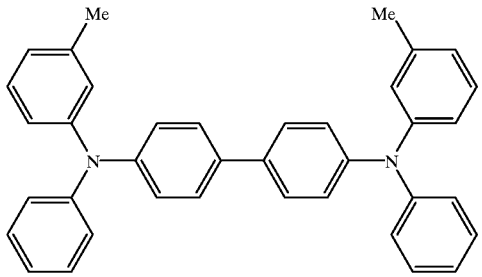

Coating agent 1-1, obtained as described above, was dip-coated onto the base photoreceptor 1, and heated and dried at 130° C. for one hour to form a surface protective layer having a film thickness of approximately 5 $\mu$m. The photoreceptor thus formed was prepared as photoreceptor 1-1.

Coating agent 1-2 was dip-coated onto the base photoreceptor 1 in the same manner, heated and dried at 130° C. for an hour to form a surface protective layer having a film thickness of approximately 5 $\mu$m. The photoreceptor thus formed was prepared as photoreceptor 1-2. The surface of each of these photoreceptors was visually observed, and the results are shown in Table 10.

(3) Actual printing test of the electrophotographic photoreceptor

Photoreceptor 1-1 and photoreceptor 1-2, thus manufactured, were respectively installed in image-forming apparatuses, Laser press 4161 II (made by Fuji Xerox Co., Ltd.), and 10000 sheets of copies of a half tone image were made using A-4 PPC paper, and after 10000 sheets of copies had been made, evaluation was made on an image (the presence or absence of defects) and the surface state (the presence or absence of scratches and residual matters) of each of the photoreceptors. The results are shown in Table 11.

Examples 2 to 19

(1) Preparation of coating agents

The same processes as in Example 1 were carried out except that, in Example 1, sample compound No. 28 was replaced by component 1 of Table 9 and bistrimethoxysilylhexane was replaced by component 2 of Table 9 with the amount of added water being changed to the amount shown in Table 9; thus, coating agents 2-1 to 19-1 and coating agents 2-2 to 19-2 were prepared.

(2) Manufacturing processes of an electrophotographic photoreceptor

The same processes as Example 1 were carried out except that instead of coating agent 1-1 and coating agent 1-2, coating agents 2-1 to 19-1 and coating agents 2-2 to 19-2 were respectively used; thus, photoreceptors 2-1 to 19-1 and photoreceptors 2-2 to 19-2 were respectively manufactured, and the surface state of each of the photoreceptors was visually observed. The results are shown in Table 10.

(3) Actual printing tests of electrophotographic photoreceptors

The same printing processes as Example 1 were carried out except that instead of photoreceptor 1-1 and photoreceptor 1-2, photoreceptors 2-1 to 19-1 and photoreceptors 2-2 to 19-2 were respectively used; thus, printing tests were conducted. The results are shown in Table 11.

Comparative Example 1

(1) Preparation of a coating agent

Sample composition No. 28 (2 parts), 2 parts of bistrimethoxysilylhexane, 4 parts of IPA and 2 parts of methanol were loaded and mixed sufficiently. Further, to this was added 0.2 parts of an ion exchange resin (Amber List 15E), 1.68 parts of distilled water, and this was stirred at room temperature for 24 hours. Then, it was confirmed that the sample composition No. 28 was eliminated by using TLC (thin-film chromatography, developing solvent: hexane/ethylacetate=3/1, adsorbent: silica gel). Thereafter, the ion exchange resin was filtrated through a simplified filter device using absorbent cotton, and to this was added 0.05 parts of aluminum trisacetylacetonate, and dissolved therein. This was then allowed to stand still at room temperature for 16 hours to obtain coating agent ref1-1. Here, slight deposition was observed in this coating agent. The deposition of coating agent ref1-1 was filtrated through a membrane filter, and this was further allowed to stand still at room temperature for 40 hours; thus, the resulting solution was prepared as coating agent ref1-2. Here, deposition was observed in this coating agent.

(2) Manufacturing processes of an electrophotographic photoreceptor

The same processes as Example 1 were carried out except that instead of coating agent 1-1 and coating agent 1-2, coating agent ref1-1 and coating agent ref1-2 were respectively used; thus, photoreceptor ref1-l and photoreceptor ref1-2 were respectively manufactured, and the surface state of each of the photoreceptors was visually observed. The results are shown in Table 10.

(3) Actual printing tests of electrophotographic photoreceptors

The same printing processes as Example 1 were carried out except that instead of photoreceptor 1-1 and photoreceptor 1-2, photoreceptor ref1-1 and photoreceptor ref1-2 were respectively used; thus, printing tests were conducted. The results are shown in Table 11.

TABLE 9

| | Coating gent composition | | | | | | Still standing time | |
|---|---|---|---|---|---|---|---|---|
| Example | Component 1 | | Component 2 | | Methanol | Water | 16 hours | 40 hours |
| Example 2 | Sample compound No. 33 | 2 parts | Bistrimethoxysilylhexane | 2 parts | 2 parts | 1.68 parts | Coating agent 2-1 | Coating agent 2-2 |
| Example 3 | Sample compound No. 33 | 2 parts | Bis(methyldimethoxysilyl)hexane | 2 parts | 2 parts | 1.33 parts | Coating agent 3-1 | Coating agent 3-2 |
| Example 4 | Sample compound No. 33 | 2 parts | Bistrimethoxysilylethane | 2 parts | 2 parts | 1.95 parts | Coating agent 4-1 | Coating agent 4-2 |
| Example 5 | Sample compound No. 33 | 2 parts | Tetramethoxysilane | 2 parts | 2 parts | 2.25 parts | Coating agent 5-1 | Coating agent 5-2 |
| Example 6 | Sample compound No. 34 | 2 parts | Methyltrimethoxysilane | 2 parts | 2 parts | 1.94 parts | Coating agent 6-1 | Coating agent 6-2 |
| Example 7 | Sample compound No. 34 | 2 parts | Bistrimethoxysilylethane | 2 parts | 2 parts | 1.85 parts | Coating agent 7-1 | Coating agent 7-2 |
| Example 8 | Sample compound No. 46 | 2 parts | Tetramethoxysilane | 2 parts | 2 parts | 2.15 parts | Coating agent 8-1 | Coating agent 8-2 |
| Example 9 | Sample compound No. 46 | 2 parts | Bis(methyldimethoxysilyl)hexane | 2 parts | 2 parts | 1.46 parts | Coating agent 9-1 | Coating agent 9-2 |
| Example 10 | Sample compound No. 9 | 2 parts | Methyltrimethoxysilane | 2 parts | 2 parts | 2.07 parts | Coating agent 10-1 | Coating agent 10-2 |
| Example 11 | Sample compound No. 10 | 2 parts | Bistrimethoxysilylethane | 2 parts | 2 parts | 1.95 parts | Coating agent 11-1 | Coating agent 11-2 |
| Example 12 | Sample compound No. 10 | 2 parts | Bistrimethoxysilylethane | 2 parts | 2 parts | 1.92 parts | Coating agent 12-1 | Coating agent 12-2 |
| Example 13 | Sample compound No. 21 | 2 parts | Bistrimethoxysilylhexane | 2 parts | 2 parts | 1.65 parts | Coating agent 13-1 | Coating agent 13-2 |
| Example 14 | Sample compound No. 21 | 2 parts | Methyltrimethoxysilane | 2 parts | 2 parts | 2.04 parts | Coating agent 14-1 | Coating agent 14-2 |
| Example 15 | Sample compound No. 21 | 2 parts | Bistrimethoxysilylethane | 2 parts | 2 parts | 2.05 parts | Coating agent 15-1 | Coating agent 15-2 |
| Example 16 | Sample compound No. 21 | 2 parts | Bistrimethoxysilylhexane | 2 parts | 2 parts | 1.77 parts | Coating agent 16-1 | Coating agent 16-2 |
| Example 17 | Sample compound No. 21 | 2 parts | Bis(methyldimethoxysilyl)hexane | 2 parts | 2 parts | 1.43 parts | Coating agent 17-1 | Coating agent 17-2 |
| Example 18 | Sample compound No. 22 | 2 parts | Bistrimethoxysilylethane | 2 parts | 2 parts | 1.92 parts | Coating agent 18-1 | Coating agent 18-2 |
| Example 19 | Sample compound No. 22 | 2 parts | Bistrimethoxysilylhexane | 2 parts | 2 parts | 1.65 parts | Coating agent 19-1 | Coating agent 19-2 |

TABLE 10

| Example | Coating agent | Photoreceptor | Surface state | Coating agent | Photoreceptor | Surface state |
|---|---|---|---|---|---|---|
| Example 1 | Coating agent 1-1 | Photoreceptor 1-1 | Good | Coating agent 1-2 | Photoreceptor 1-2 | Good |
| Example 2 | Coating agent 2-1 | Photoreceptor 2-1 | Good | Coating agent 2-2 | Photoreceptor 2-2 | Good |
| Example 3 | Coating agent 3-1 | Photoreceptor 3-1 | Good | Coating agent 3-2 | Photoreceptor 3-2 | Good |
| Example 4 | Coating agent 4-1 | Photoreceptor 4-1 | Good | Coating agent 4-2 | Photoreceptor 4-2 | Good |
| Example 5 | Coating agent 5-1 | Photoreceptor 5-1 | Good | Coating agent 5-2 | Photoreceptor 5-2 | Good |
| Example 6 | Coating agent 6-1 | Photoreceptor 6-1 | Good | Coating agent 6-2 | Photoreceptor 6-2 | Good |
| Example 7 | Coating agent 7-1 | Photoreceptor 7-1 | Good | Coating agent 7-2 | Photoreceptor 7-2 | Good |

TABLE 10-continued

| Example | Coating agent | Photoreceptor | Surface state | Coating agent | Photoreceptor | Surface state |
|---|---|---|---|---|---|---|
| Example 8 | Coating agent 8-1 | Photoreceptor 8-1 | Good | Coating agent 8-2 | Photoreceptor 8-2 | Good |
| Example 9 | Coating agent 9-1 | Photoreceptor 9-1 | Good | Coating agent 9-2 | Photoreceptor 9-2 | Good |
| Example 10 | Coating agent 10-1 | Photoreceptor 10-1 | Good | Coating agent 10-2 | Photoreceptor 10-2 | Good |
| Example 11 | Coating agent 11-1 | Photoreceptor 11-1 | Good | Coating agent 11-2 | Photoreceptor 11-2 | Good |
| Example 12 | Coating agent 12-1 | Photoreceptor 12-1 | Good | Coating agent 12-2 | Photoreceptor 12-2 | Good |
| Example 13 | Coating agent 13-1 | Photoreceptor 13-1 | Good | Coating agent 13-2 | Photoreceptor 13-2 | Good |
| Example 14 | Coating agent 14-1 | Photoreceptor 14-1 | Good | Coating agent 14-2 | Photoreceptor 14-2 | Good |
| Example 15 | Coating agent 15-1 | Photoreceptor 15-1 | Good | Coating agent 15-2 | Photoreceptor 15-2 | Good |
| Example 16 | Coating agent 16-1 | Photoreceptor 16-1 | Good | Coating agent 16-2 | Photoreceptor 16-2 | Good |
| Example 17 | Coating agent 17-1 | Photoreceptor 17-1 | Good | Coating agent 17-2 | Photoreceptor 17-2 | Good |
| Example 18 | Coating agent 18-1 | Photoreceptor 18-1 | Good | Coating agent 18-2 | Photoreceptor 18-2 | Good |
| Example 19 | Coating agent 19-1 | Photoreceptor 19-1 | Good | Coating agent 19-2 | Photoreceptor 19-2 | Good |
| Comparative example 1 | Coating agent ref 1-1 | Photoreceptor ref 1-1 | Partial defective film formation with slight irregularity | Coating agent ref 1-2 | Photoreceptor ref 1-2 | Partial defective film formation with slight irregularity |

TABLE 11

| | | After 10000 prints | | | After 10000 prints | |
|---|---|---|---|---|---|---|
| Example | Photoreceptor | Image | Surface state | Photoreceptor | Image | Surface state |
| Example 1 | Photoreceptor 1-1 | Good | Good | Photoreceptor 1-2 | Good | Good |
| Example 2 | Photoreceptor 2-1 | Good | Good | Photoreceptor 2-2 | Good | Good |
| Example 3 | Photoreceptor 3-1 | Good | Good | Photoreceptor 3-2 | Good | Good |
| Example 4 | Photoreceptor 4-1 | Good | Good | Photoreceptor 4-2 | Good | Good |
| Example 5 | Photoreceptor 5-1 | Good | Good | Photoreceptor 5-2 | Good | Good |
| Example 6 | Photoreceptor 6-1 | Good | Good | Photoreceptor 6-2 | Good | Good |
| Example 7 | Photoreceptor 7-1 | Good | Good | Photoreceptor 7-2 | Good | Good |
| Example 8 | Photoreceptor 8-1 | Good | Good | Photoreceptor 8-2 | Good | Good |
| Example 9 | Photoreceptor 9-1 | Good | Good | Photoreceptor 9-2 | Good | Good |
| Example 10 | Photoreceptor 10-1 | Good | Good | Photoreceptor 10-2 | Good | Good |
| Example 11 | Photoreceptor 11-1 | Good | Good | Photoreceptor 11-2 | Good | Good |
| Example 12 | Photoreceptor 12-1 | Good | Good | Photoreceptor 12-2 | Good | Good |
| Example 13 | Photoreceptor 13-1 | Good | Good | Photoreceptor 13-2 | Good | Good |
| Example 14 | Photoreceptor 14-1 | Good | Good | Photoreceptor 14-2 | Good | Good |
| Example 15 | Photoreceptor 15-1 | Good | Good | Photoreceptor 15-2 | Good | Good |
| Example 16 | Photoreceptor 16-1 | Good | Good | Photoreceptor 16-2 | Good | Good |
| Example 17 | Photoreceptor 17-1 | Good | Good | Photoreceptor 17-2 | Good | Good |
| Example 18 | Photoreceptor 18-1 | Good | Good | Photoreceptor 18-2 | Good | Good |
| Example 19 | Photoreceptor 19-1 | Good | Good | Photoreceptor 19-2 | Good | Good |
| Comparative example 1 | Photoreceptor ref 1-1 | Linear image defect | Linear deposit | Photoreceptor ref 1-2 | Linear image defect | slight deposit |

What is claimed is:

1. A manufacturing method of an electronic device comprising the steps of:

preparing at least two kinds of hydrolytic silicon compounds that are different in reactivity to water;

preparing a protective group precursor having a substituent having a reactivity to water equal or substantially equal to the reactivity of a reactive group of one of the hydrolytic silicon compounds to water;

exchanging a reactive group of the other hydrolytic silicon compound with the substituent of the protective group precursor, thereby making the reactivity of the other hydrolytic silicon compound to water equal or substantially equal to the reactivity of the one of the hydrolytic silicon compounds to water;

preparing a silicon-containing coating agent containing the one of the hydrolytic silicon compounds and a hydrolytic silicon compound having the reactive group which has been exchanged with the substituent of the protective group precursor; and coating and curing the silicon-containing coating agent on a base plate so that at least one layer of a cured film is formed.

2. The manufacturing method of an electronic device according to claim 1, wherein said substituent is an alkoxyl group.

3. The manufacturing method of an electronic device according to claim 1, wherein, upon exchanging the reactive group of the other hydrolytic silicon compound with the substituent of the protective group precursor, a catalyst, which is virtually insoluble in a reaction solution in which the exchange takes place, is used.

4. The manufacturing method of an electronic device according to claim 3, wherein the catalyst is an ion exchange resin.

5. The manufacturing method of an electronic device according to claim 1, wherein primary alcohol is used as the protective group precursor.

6. The manufacturing method of an electronic device according to claim 1, wherein, a functional organic silicon compound, represented by the following formula (I), is used as one kind of the hydrolytic silicon compound:

$$F—[D—A]_b \quad (I)$$

wherein, in (I),

F represents an organic group derived from a functional compound, D represents a flexible sub-unit, A represents a substitutional silicon group having a hydrolytic group, represented by $—Si(R^1)_{(3-a)}Q_a$, $R^1$ represents a hydrogen atom, an alkyl group or a substituted or unsubstituted aryl group, Q represents a hydrolytic group, a represents an integer of 1 to 3, and b represents an integer of 1 to 4.

7. The manufacturing method of an electronic device according to claim 6, wherein the organic group F of formula (I) that is derived from the functional compound is a group having a positive hole carrier function.

8. The manufacturing method of an electronic device according to claim 6, wherein the organic group F of formula (I) that is derived from the functional compound is represented by the following formula (II):

(II)

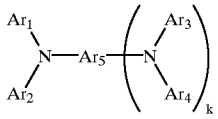

wherein, in formula (II), $Ar_1$ to $Ar_4$ independently represent substituted or unsubstituted aryl groups, $Ar_5$ represents a substituted or unsubstituted aryl or arylene group, and k represents 0 or 1 and further at least one of, $Ar_1$ to $Ar_5$, have bonds bondable to bonding groups represented by —D—A wherein D represents a flexible sub-unit, A represents a substitutional silicon group having a hydrolytic group represented by $—Si(R^1)_{(3-a)}Q_a$, $R^1$ represents a hydrogen atom, an alkyl group, or a substituted or unsubstituted aryl group, Q represents a hydrolytic group, and a represents an integer of 1 to 3.

9. The manufacturing method of an electronic device according to claim 6, wherein a silicon compound represented by the following formula (III) is used as one kind of the hydrolytic silicon compound:

$$B—[A]_n \quad (III)$$

wherein, in formula (III), A represents a substitutional silicon group having a hydrolytic group represented by $—Si(R^1)_{(3-a)}Q_a$, $R^1$ represents a hydrogen atom, an alkyl group, or a substituted or unsubstituted aryl group, Q represents a hydrolytic group, B represents at least one selected from the group consisting of n-valent hydrogen carbide group that may include a sub-chain, n-valent phenyl group, —NH— and —O—Si—, a is an integer of 1 to 3, and n is an integer of not less than 2.

10. The manufacturing method of an electronic device according to claim 1, wherein a silicon compound represented by the following formula (III) is used as one kind of the hydrolytic silicon compound:

$$B—[A]_n \quad (III)$$

wherein, in formula (III), A represents a substitutional silicon group having a hydrolytic group represented by $—Si(R^1)_{(3-a)}Q_a$, $R^1$ represents a hydrogen atom, an alkyl group, or a substituted or unsubstituted aryl group, Q represents a hydrolytic group, B represents at least one selected from the group consisting of n-valent hydrogen carbide group that may include a sub-chain, n-valent phenyl group, —NH— and —O—Si—, a is an integer of 1 to 3, and n is an integer of not less than 2.

11. The manufacturing method of an electronic device according to claim 1, wherein after the reactivity to water of said at least two kinds of hydrolytic silicon compounds have been made equal or substantially equal, said at least two kinds of hydrolytic silicon compounds are commonly hydrolyzed.

12. An electronic device comprising:

a base member having one or more layers of cured film formed by applying a silicon-containing coating agent thereto and cured thereon, wherein the silicon-containing coating agent is formed in processes in which:

at least two kinds of hydrolytic silicon compounds that are different in reactivity to water are prepared;

a protective group precursor having a substituent having a reactivity to water equal or substantially equal to the reactivity of a reactive group of one of the hydrolytic silicon compounds to water is prepared;

a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water; and a silicon-containing coating agent containing the one of the hydrolytic silicon compounds and a hydrolytic silicon compound having the reactive group which has been exchanged with the substituent of the protective group precursor is prepared.

13. An electrophotographic photoreceptor comprising:

a base member having one or more layers of cured film formed by applying a silicon-containing coating agent thereto and cured thereon, wherein the silicon-containing coating agent is formed in processes in which:

at least two kinds of hydrolytic silicon compounds that are different in reactivity to water are prepared;

a protective group precursor having a substituent having a reactivity to water equal or substantially equal to the reactivity of a reactive group of one of the hydrolytic silicon compounds to water is prepared;

a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water; and a silicon-containing coating agent containing the one of the hydrolytic silicon compounds and a hydrolytic silicon compound having the reactive group which has been exchanged with the substituent of the protective group precursor is prepared.

14. The electrophotographic photoreceptor according to claim 13, wherein a cured layer formed by applying and curing the silicon-containing coating agent is placed on an uppermost surface layer.

15. A process cartridge comprising:

an electrophotographic photoreceptor and at least one member selected from the group consisting of a charging device, a static eliminator and a cleaning device, and which is detachably attached to an image-forming apparatus, wherein the electrophotographic photoreceptor comprising:

a base member having one or more layers of cured film formed by applying a silicon-containing coating agent thereto and cured thereon, wherein the silicon-containing coating agent is formed in processes in which:

at least two kinds of hydrolytic silicon compounds that are different in reactivity to water are prepared;

a protective group precursor having a substituent having a reactivity to water equal or substantially equal to the reactivity of a reactive group of one of the hydrolytic silicon compounds to water is prepared;

a reactive group of the other hydrolytic silicon compound is exchanged with the substituent of the protective group precursor, thereby making the reactivity of the other hydrolytic silicon compound to water equal or substantially equal to the reactivity of the one of the hydrolytic silicon compounds to water; and a silicon-containing coating agent containing the one of the hydrolytic silicon compounds and a hydrolytic silicon compound having the reactive group which has been exchanged with the substituent of the protective group precursor is prepared.

16. The process cartridge according to claim 15, wherein the process cartridge which has been used up is recycled by filling the cartridge with toner.

* * * * *